US011346147B2

(12) United States Patent
Header et al.

(10) Patent No.: US 11,346,147 B2
(45) Date of Patent: May 31, 2022

(54) MODULAR SILL

(71) Applicant: Solar Innovations LLC, Pine Grove, PA (US)

(72) Inventors: Gregory A Header, Richland, PA (US); Ari Figueroa, Middleton, PA (US)

(73) Assignee: Solar Innovations LLC, Pine Grove, PA (US)

( * ) Notice: Subject to any disclaimer, the term of this patent is extended or adjusted under 35 U.S.C. 154(b) by 21 days.

(21) Appl. No.: 16/948,783

(22) Filed: Oct. 1, 2020

(65) Prior Publication Data

US 2022/0106827 A1 Apr. 7, 2022

(51) Int. Cl.
*E06B 1/70* (2006.01)
*E06B 3/26* (2006.01)

(52) U.S. Cl.
CPC ..... *E06B 1/702* (2013.01); *E06B 3/26* (2013.01)

(58) Field of Classification Search
CPC ... E06B 7/14; E06B 1/70; E06B 1/702; E06B 3/26
See application file for complete search history.

(56) References Cited

U.S. PATENT DOCUMENTS 3,410,027 A 11/1968 Bates
3,845,599 A 11/1974 Jolly
4,237,664 A 12/1980 Wilmes
4,387,535 A * 6/1983 Corbo ..... E06B 1/70 49/468
4,553,361 A 11/1985 Ralph
(Continued)

FOREIGN PATENT DOCUMENTS

AU 2007200569 A1 11/2007
AU 2007203218 A1 1/2009
(Continued)

OTHER PUBLICATIONS

Flowthrough Integrated Stainless Steel Threshold Drain (cutsheet), Jul. 2018, Architectural Window Systems, Pty Ltd., Prestons NSW, Australia.
(Continued)

*Primary Examiner* — Andrew J Triggs
(74) *Attorney, Agent, or Firm* — Stone Creek Services LLC; Alan M Flum

(57) ABSTRACT

A sill assembly that can include a sill and one or more threshold inserts. The threshold inserts can cover cavities within the sill. The sill assembly can optionally include a subsill, which can be a separate from or part of the sill. The subsill can include subsill cavities aligned over the sill cavities to form vertically-stacked pressure chambers. These vertically-stacked pressure chambers can include vertically-stacked pressure chambers positioned within the interior of the building, and vertically-stacked pressure chambers positioned within the exterior of the building. The sill assembly is so structured that different door types, such as swing doors, pivot doors, folding doors and/or sliding doors can be accommodated using the same sill and subsill by simply changing the threshold inserts. The sill assembly can have a minimal rise above the floor surface to meet regulatory requirements such as the Americans with Disabilities Act (ADA).

20 Claims, 24 Drawing Sheets

(56) References Cited

U.S. PATENT DOCUMENTS

| | | | | |
|---|---|---|---|---|
| 7,263,808 | B2 | 9/2007 | Massey et al. | |
| 8,499,498 | B2 | 8/2013 | Heppner | |
| 8,601,751 | B2 | 12/2013 | Carter | |
| 8,683,747 | B2 * | 4/2014 | Kim | E06B 7/14 49/471 |
| 9,097,059 | B1 | 8/2015 | Flynn et al. | |
| 10,472,882 | B1 | 11/2019 | Pettibone | |
| 11,136,802 | B2 * | 10/2021 | Tsimbikos | E06B 3/46 |
| 2003/0177699 | A1 | 9/2003 | Fukuro et al. | |
| 2014/0260011 | A1 | 9/2014 | Pettibone | |
| 2016/0281417 | A1 | 9/2016 | Harte | |
| 2017/0183896 | A1 | 6/2017 | Dastrup | |
| 2017/0234060 | A1 | 8/2017 | Graetsch et al. | |
| 2019/0383078 | A1 * | 12/2019 | Tsimbikos | E06B 3/46 |
| 2020/0224486 | A1 | 7/2020 | Anderson et al. | |
| 2020/0318419 | A1 * | 10/2020 | Guhl | E06B 1/70 |

FOREIGN PATENT DOCUMENTS

| | | | |
|---|---|---|---|
| AU | 2016256750 | B1 | 6/2017 |
| CN | 205151486 | U | 4/2016 |
| CN | 207375572 | U | 5/2018 |
| CN | 109469426 | A | 3/2019 |
| EP | 2284350 | A2 | 2/2011 |
| JP | H04360982 | A | 12/1992 |
| JP | H0828144 | A | 1/1996 |

OTHER PUBLICATIONS

AWS FlowTHRU (home page), downloaded from the Internet from https://www.awsflowthru.com.au on Aug. 25, 2020.

Fleetwood Windows and Doors Aluminum Products Catalog, Nov. 2019, Fleetwood Windows and Doors, Corona, California.

Fleetwood Windows and Doors Impact Products Catalog, May 2018, Fleetwood Windows and Doors, Corona, California.

Fleetwood Edge Installation Instructions, Jun. 2020, Fleetwood Windows and Doors, Corona, California.

Frequently Asked Questions Zero Threshold Drain, Jan. 2019, Creative Drain Solutions, Ferntree Gully, Victoria, Australia.

Creative Drain Solutions Threshold Solutions, downloaded from the Internet from https://www.creativedrainsolutions.com.au/zero-threshold-solutions on Aug. 24, 2020.

Raintrak, Aug. 2020, ACO Pty Ltd, Emu Plains, NSW, Australia.

Installation Drawing Raintrak-O, Drawing No. RT001, May 2020, ACO Pty Ltd, Emu Plains, NSW, Australia.

Adaptive Sill System, Jul. 2020, Endura Products Inc, Colfax, North Carolina.

Aluminum Inswing Sectionals-ADA Compliant Sill Ramp, 4935-011, Mar. 2017, LaCantina Doors, Oceanside, California.

Maco Multi Zero Locking Hook for Zero-Barrier Threshold Systems, Oct. 2016, Maco Doorand Window Hardware (UK) Ltd, Sittingbourne, Kent, United Kingdom.

Duration Windows, Continental Folding Doors Thresholds, Floor Levels & Drainage, Aug. 2011, Duration Windows, Canvey Island, Essex, United Kingdom.

IQ Glass Specification Flush Threshold Drain, Jul. 2014, IQ Glass Solutions Ltd, Amersham, United Kingdom.

APL Architectural Series Minima Sliding Doors, Aug. 2019, Architectural Profiles Ltd, Hamilton, New Zealand.

Flush Sill Threshold for APL Architectural Series Sliders, Vantage Windows and Doors, Aug. 2013, downloaded from the Internet from https://www eboss.co.nz/ebossnow/flush-sill-threshold-for-apl-architectural-series-sliders on Aug. 29, 2020.

New Easy-Glide Sliding Doors, Vantage Windows and Doors, Jul. 2012, downloaded from the Internet from https://www.eboss.co.nz/ebossnow/easy-glide-sliding-doors on Aug. 29, 2020.

InteGrate Drainage Systems Game-Changing Flush-Sill Innovation from Ezial, Nov. 2018, Exail Aluminum Systems PTY LTD, Wynnum, Austrailia.

Peerless French Doors, Peerless Products, Inc., Fort Scott, Kansas, downloaded from the Internet from https://www.peerlessproducts.com/Products/Peerless-Doors/French-Doors on Sep. 8, 2020.

* cited by examiner

MODULAR SILL

BACKGROUND

The present disclosure relates to sill assemblies for doors, windows, and other building fenestrations.

Protecting buildings and their occupants from outside elements such as rain or wind is a design consideration in building construction. Windows and doors are potential sources for air and water leakage. For example, the seals around the edges of window sashes or door jambs are potential sources of water penetration as are the seals around glass for glazed windows and doors. Roof overhangs and gutters can deflect rain from windows and doors. However, wind-driven rain can be a challenge. Water can be forcefully driven onto window and door surfaces, into seals, and into other surrounding surfaces.

Sill assemblies can create an air and/or moisture barrier between the interior and exterior of a doorway opening. For example, a sill can create a weather seal beneath a door to prevent water and outside air from entering the building. A sill can also drain out water that penetrates window or door seals.

Some sill assemblies have a low profile or low rise above the surrounding floor. Low-profile sills can be installed for aesthetics and/or to meet national, regional, or local law. For example, the Americans with Disabilities Act (ADA) in the United States govern door sill height for accessibility.

Low-profile sill assemblies use various strategies to keep water and air from entering the building under the door. However, because of the sill assembly's low profile it is challenging to achieve good water penetration resistance.

SUMMARY

The inventors developed sill assemblies that can have improved water performance even while meeting ADA standards. For example, during testing of a sliding door assembly with a prototype sill assembly that embodies principles disclosed, the ADA-type sill achieved 15 psf (718.2 Pa) at 5.0 gph/ft$^2$ (146.7 m s), which greatly exceeded performance expectations for a sliding door with an ADA sill.

In addition, the inventors developed sill assemblies, examples of which are described in this disclosure, that can accommodate different door types by changing out threshold inserts and without modification to the sill or the optional subsill. This can simplify manufacturing, installation, logistics, and/or costs by providing common sill and subsill subassemblies throughout an installation. Examples of different door types that might be accommodated include swing doors, pivot doors, folding doors, and/or sliding doors. It may be possible to accommodate inswing doors, outswing doors, top-loaded folding doors, bottom-loaded folding doors, top-loaded sliding doors, and/or bottom-loaded folding doors, lift slide doors, sliding and stacking doors, and sliding pocket doors by using threshold inserts that are sized, shaped, and/or positioned to accommodate a corresponding door type. The sill assemblies discussed in this disclosure can be adapted for use with windows. For example, windows that are designed as ADA egress windows, again, by changing the shape, size, and/or position of the threshold inserts. The sill assemblies can also be used with low-profile non-ADA egress windows, or even for standard window openings.

The threshold inserts are typically installed within sill cavities of a sill. The sill can have perimeter walls that include a sill bottom wall, a first sill sidewall, and a second sill sidewall. The sill cavities can be formed by a sill upleg projecting from the sill bottom surface positioned between sill sidewalls. Typically, a first sill threshold would be installed in a first sill cavity positioned between the sill upleg and a first sill sidewall. A portion of the first sill threshold can cover the first sill cavity and form a first top surface of the sill. A second sill threshold would be installed in a second sill cavity positioned between the sill upleg and a second sill sidewall. A portion of the second sill threshold can cover the second sill cavity and form a second top surface of the sill. With an operable door installed over the first sill cavity and first threshold insert, the first sill cavity can be positioned within an unprotected environment, such as the exterior of a building, while the second sill cavity can be positioned within a protected environment or interior environment.

In the above described example, the first sill cavity, combined with the first threshold insert can be configured to form a pressure chamber in the unprotected environment while the second sill cavity, combined with the second threshold insert can be configured to form a pressure chamber in the protected environment.

The sill can optionally include flanges that project outward from the sill in opposite directions. For example, the first sill flange, could project from the first sidewall and rest against the floor in the unprotected environment while the second flange could project outward from the second sidewall and rest against the floor in the protected environment. Portions of the sill below the flange could be recessed below the floor, for example, within a drain trough or French drain.

In one example, a sill assembly can optionally include a subsill or tank installed under the sill. The subsill could similarly be divided into a first subsill cavity and a second subsill cavity by a subsill upleg. The first subsill cavity could be aligned directly under the first sill cavity so they could both reside within the unprotected environment. Similarly, the second subsill cavity could be aligned directly under the first sill cavity so they both reside within the protected environment. The first subsill cavity and the second subsill cavity could be bounded by the sill bottom wall to create pressure chambers. The first sill cavity and the first subsill cavity could form a first vertically-stacked pressure chamber pair aligned over the operable door and residing within the unprotected environment. The second sill cavity and the second subsill cavity could form a second vertically-stacked pressure chamber pair, interior to the operable door and residing within the protected environment.

The sill and subsill can use a combination of apertures, weep holes, weep flaps, one-way valves, and/or drain tubes to control air pressure and water drainage. For example, the subsill, and optionally the sill, could include weep holes to drain water into the unprotected environment, for example, a drain trough mounted beneath the subsill. The subsill could include apertures in the subsill upleg that regulate the pressure between the first subsill cavity and the second subsill cavity and also allow water in the second subsill cavity to drain into the first subsill cavity through weep holes, or weep holes equipped with weep flaps, into the unprotected environment. The sill could optionally include apertures through the sill upleg to regulate pressure between the first sill cavity and the second sill cavity, and optionally provide an overflow path. The second sill cavity could include an aperture in the sill bottom wall to help improve performance. This aperture could provide an air path from the protected environment into the second subsill cavity and so provide an overflow drain path from the second sill cavity. Optionally, one-way valves can be attached to apertures in the subsill upleg to allow water to drain out of the second subsill cavity into the first subsill cavity, while preventing backflow. Similarly, if the sill upleg has apertures, for example, when the sill is used without a subsill, these apertures can have one-way valves to prevent back flow.

The subsill can optionally include an upper cavity residing above the subsill upleg between the first subsill sidewall and a second subsill sidewall. In this example, the portion of the sill below the sill flanges can reside within the upper cavity. The first sill flange, projecting from the first sidewall, can rest against the floor in the unprotected environment, while the second flange that projects outward from the second sidewall can rest against the floor in the protected environment. Portions of the sill below the flanges and the subsill can rest below the floor, for example, within a drain trough.

The sill and subsill can be extruded, molded, cast, or otherwise formed as separate parts. It is also possible to produce a sill that integrates the features and structure of the sill and subsill. This sill could be less expensive than a separate sill and subsill. However, this sill may sacrifice performance because there can be limitations to machining and other secondary processes that can be performed on a single sill versus a separate sill and subsill. Similarly, it is possible to integrate some of the threshold inserts into the sill. This can simplify assembly and reduce the number of separate parts that need to be installed. However, this has can have the disadvantage of not being able to accommodate as many types of doors or windows.

This Summary introduced a selection of concepts in simplified form described in the Description, to help the reader to gain an overview of some concepts described in this disclosure. The Summary is not intended to limit the scope of the claims.

DRAWINGS

DESCRIPTION

When describing the figures, the terms "front," "rear," and "side," are from the perspective of a person looking from an unprotected environment looking toward a protected environment. As defined in this disclosure, a protected environment is an enclosed space where it is desirable to prevent infiltration of air, water, and/or other environmental elements. As defined in this disclosure, an unprotected environment from the perspective of the protected environment, is an environment that may include air, water, or other undesirable environmental elements that could infiltrate the protected environment. The protected environment is typically within a building structure. The unprotected environment is typically outside the building and might be exposed to rain, wind, and the elements.

Specific dimensions are intended to help the reader understand the scale and advantage of the disclosed material. Dimensions given are typical and the disclosed sill assemblies are not limited to the recited dimensions.

Figure 1:
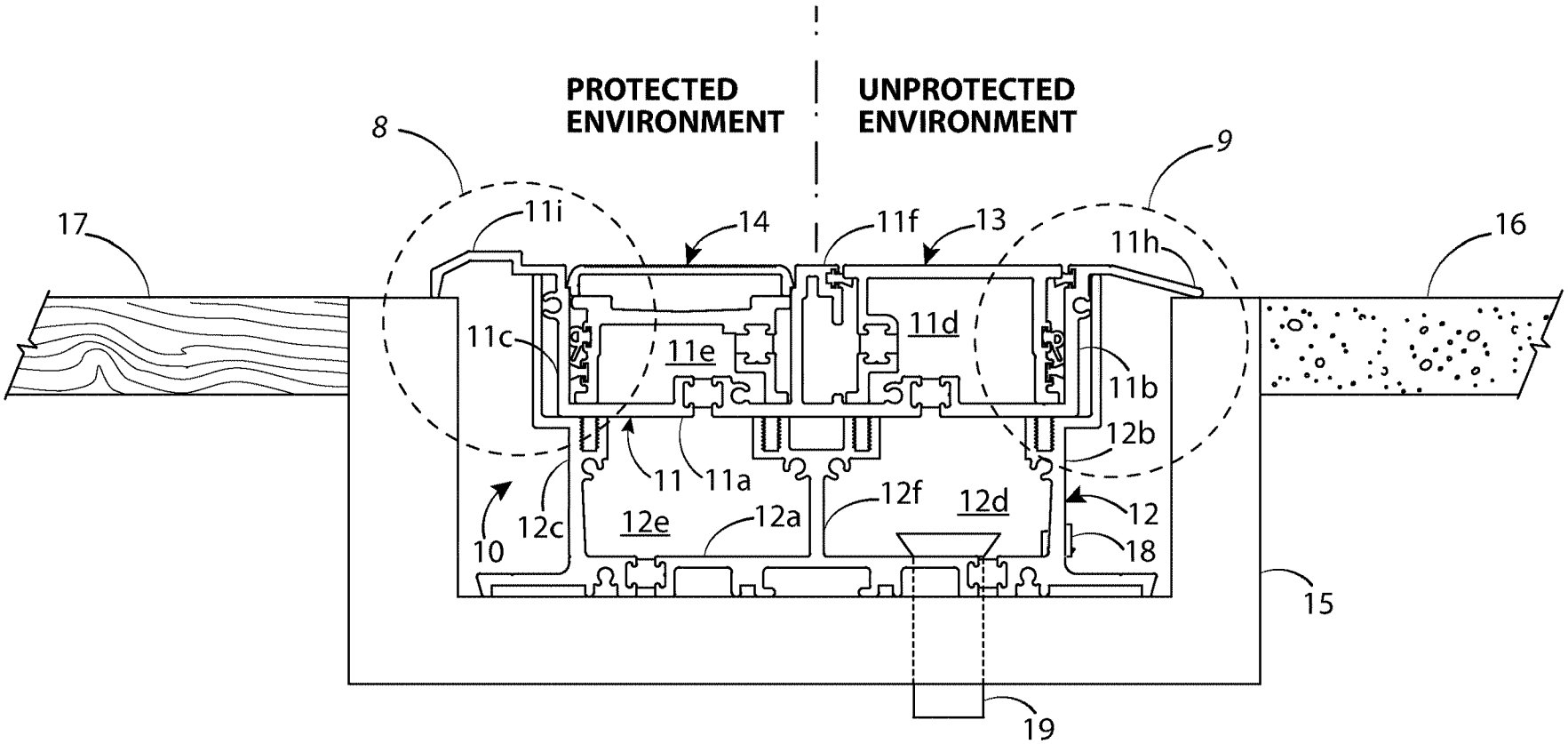
FIG. 1 illustrates a side elevation view of a sill assembly of the present disclosure shown mounted within a typical installation environment including a floor and sill drain cavity.
Figure 23:
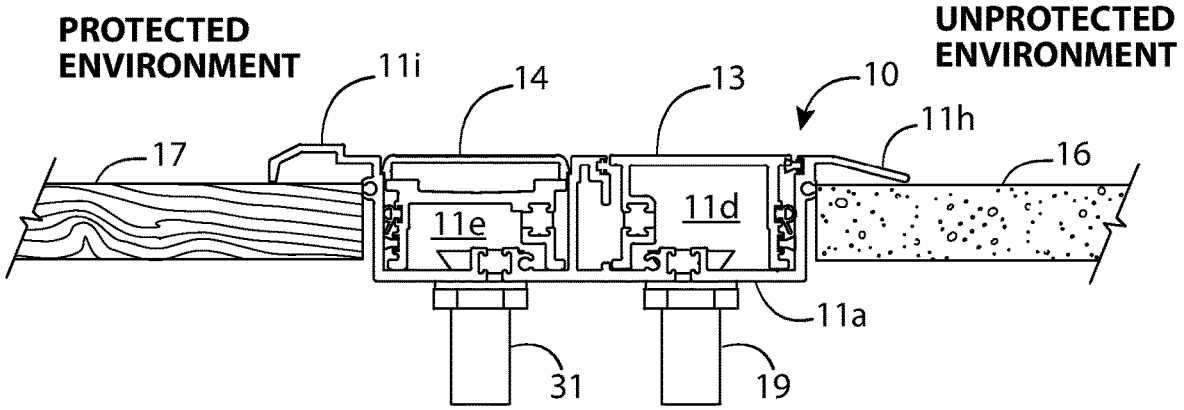
FIG. 23 illustrates an example the sill and the threshold inserts of the present disclosure installed in a typical installation environment without the subsill.
Figure 24:
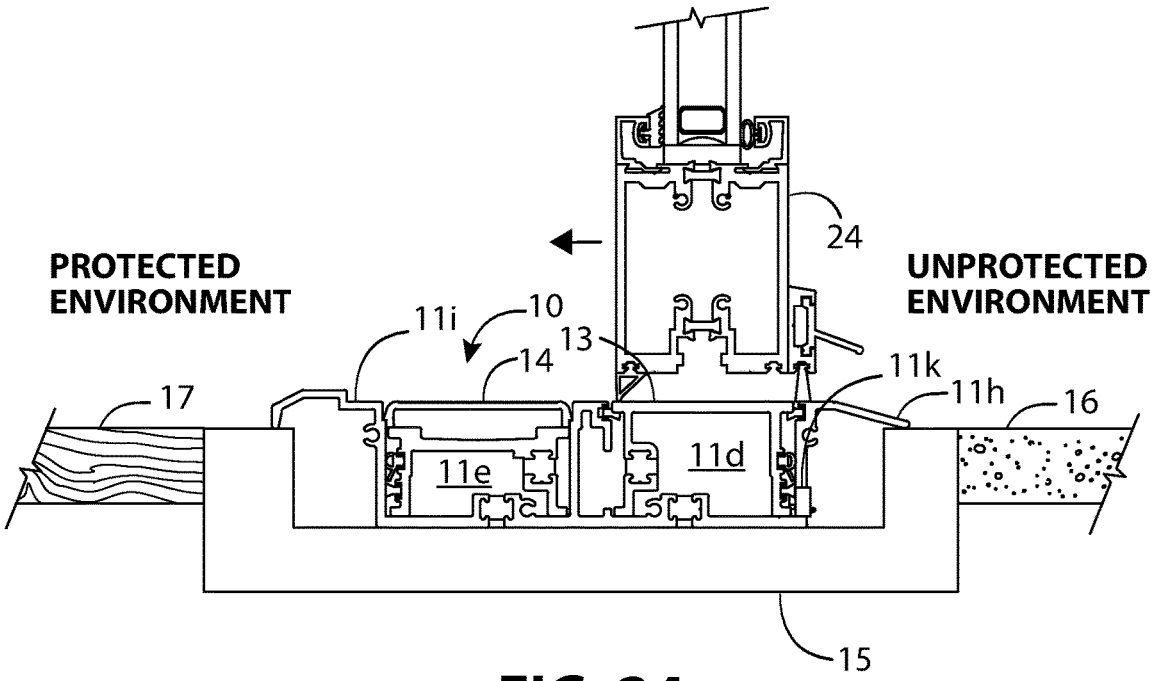
FIG. 24 illustrates alternative example the sill and the threshold inserts of the present disclosure installed in a typical installation environment without the subsill.
Figure 25:
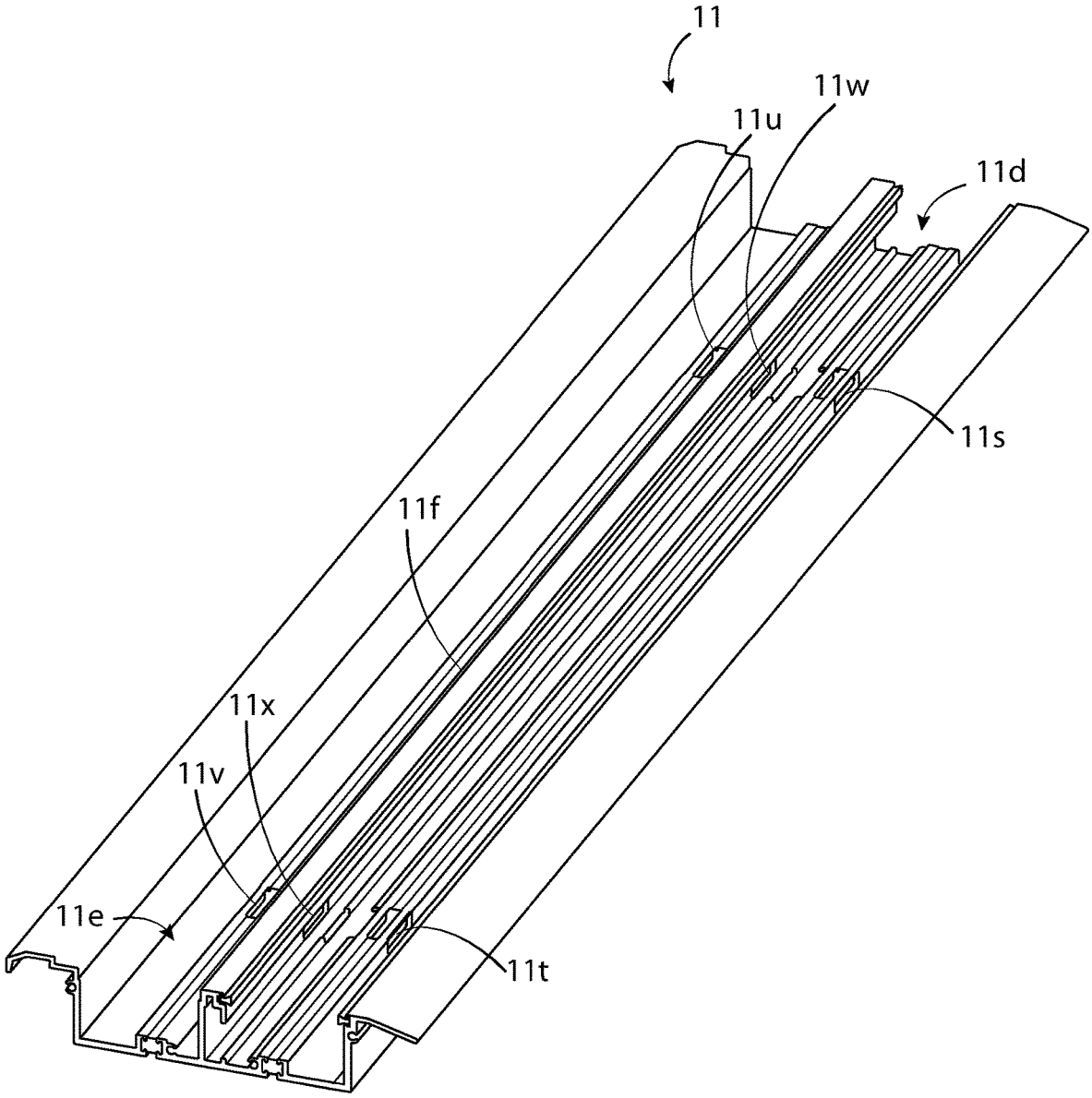
FIG. 25 illustrates the sill of FIG. 24 in top isometric view.
Figure 26:
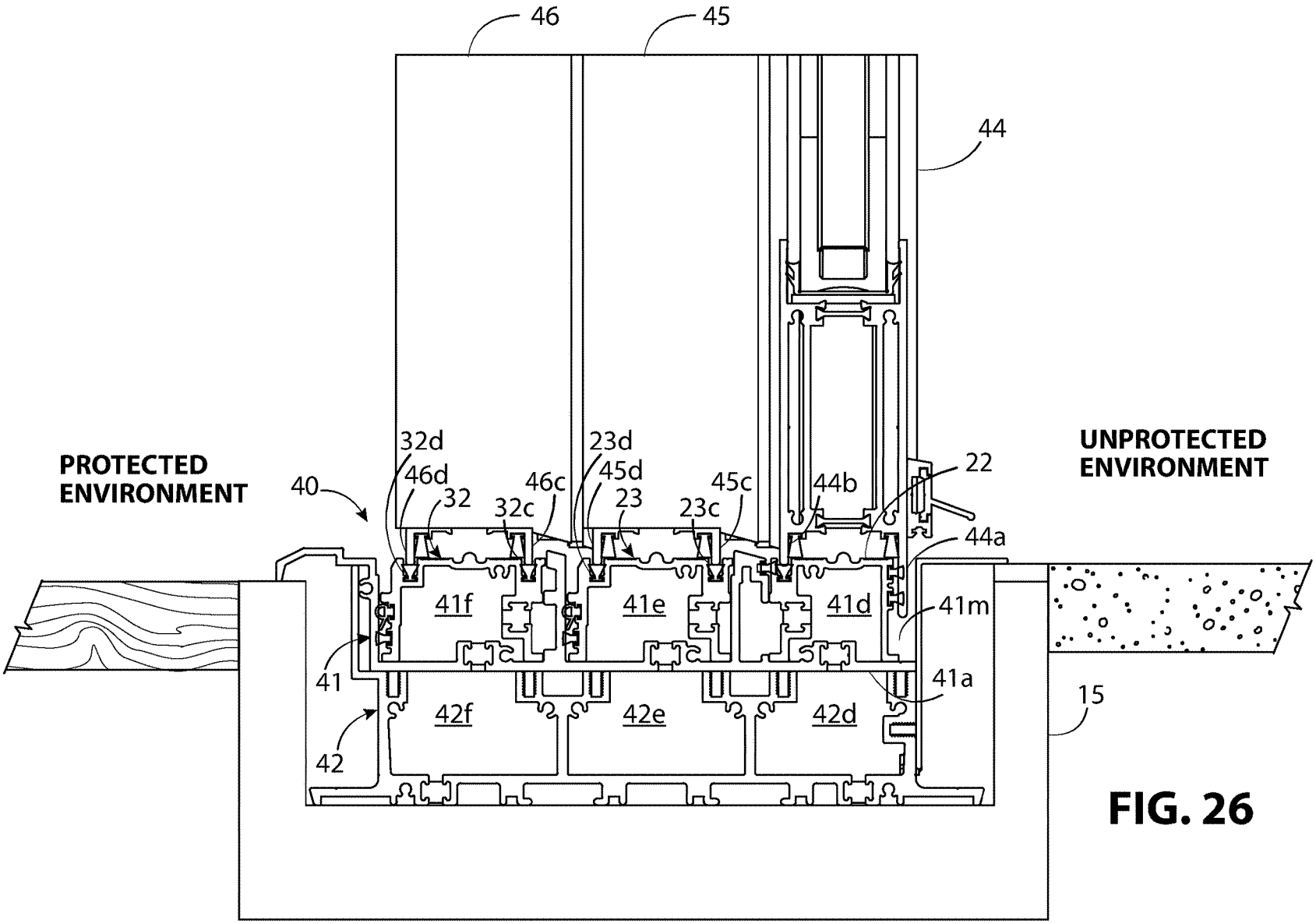
FIG. 26 illustrates a side elevation view of the sill assembly of the present disclosure installed in a typical installation environment, with the threshold inserts configured to receive a three-panel sliding door assembly with a portion of the three-panel sliding door assembly shown.
Figure 27:
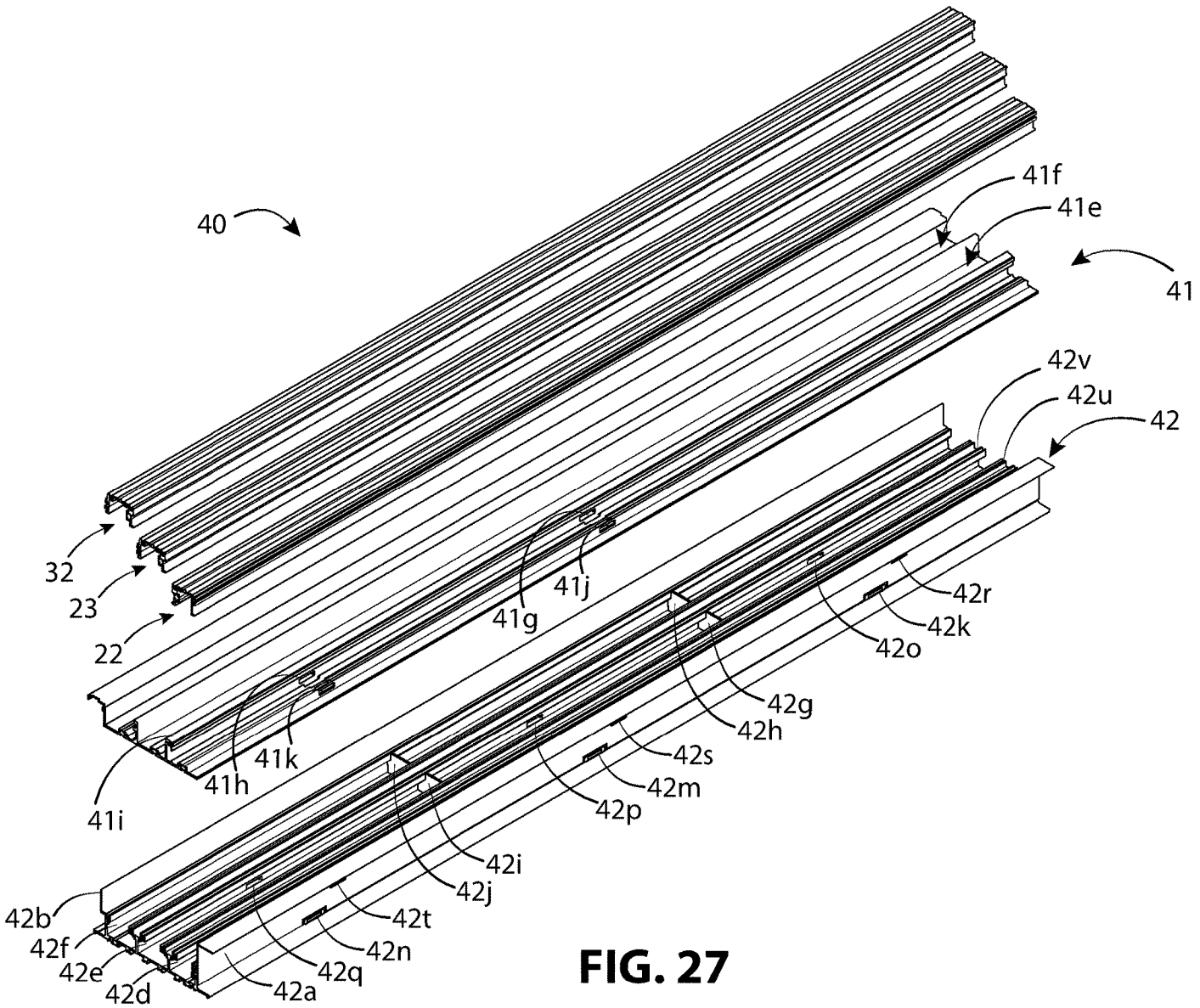
FIG. 27 illustrates an exploded and isometric view of sill assembly of FIG. 26.

The following Description is made referring to figures, where like numerals refer to like elements throughout the figures. FIGS. 1-22 illustrate one example of a sill assembly of the present disclosure, that can accommodate different door types by changing out threshold inserts and without modification to the sill or the optional subsill. For example, by simply changing threshold inserts it is possible to accommodate swing doors, pivot doors, folding doors, and sliding doors. This can potentially simplify manufacturing and improve logistics since one sill and subsill can accommodate several door types. It can also simplify installation and reduce installation costs since there can be fewer parts to be carried onto the job site. FIGS. 1-13 illustrate the structural components of the sill assembly while FIGS. 14-22 illustrate how the sill assembly can be applied to the different door types described above. FIGS. 23-25 illustrate how the sill and threshold inserts of FIGS. 1-22 can optionally be installed without the subsill. FIGS. 26 and 27 illustrate how the sill assembly can be modified for use with three or more sliding glass doors. FIGS. 28-32 show variants of the sill and subsill that can be used with the threshold inserts of FIGS. 1-22. The disclosed sill assemblies can be used for applications that require a low-profile sill, for example, for aesthetics and/or to meet regulatory requirements such as ADA. Note that will the sill assemblies described can meet ADA regulatory requirements, they can also be used in non-ADA applications, for example as low-profile sill assemblies. The sills can also be adapted to have a higher profile to achieve even better weather performance. Referring to FIG. 1, the depth and height of the sill 11 and subsill 12 as well as the angle and shape of the first sill flange 11*h* and the second sill flange 11*i* can be adjusted to accommodate the above-mentioned variations.

Figure 2:
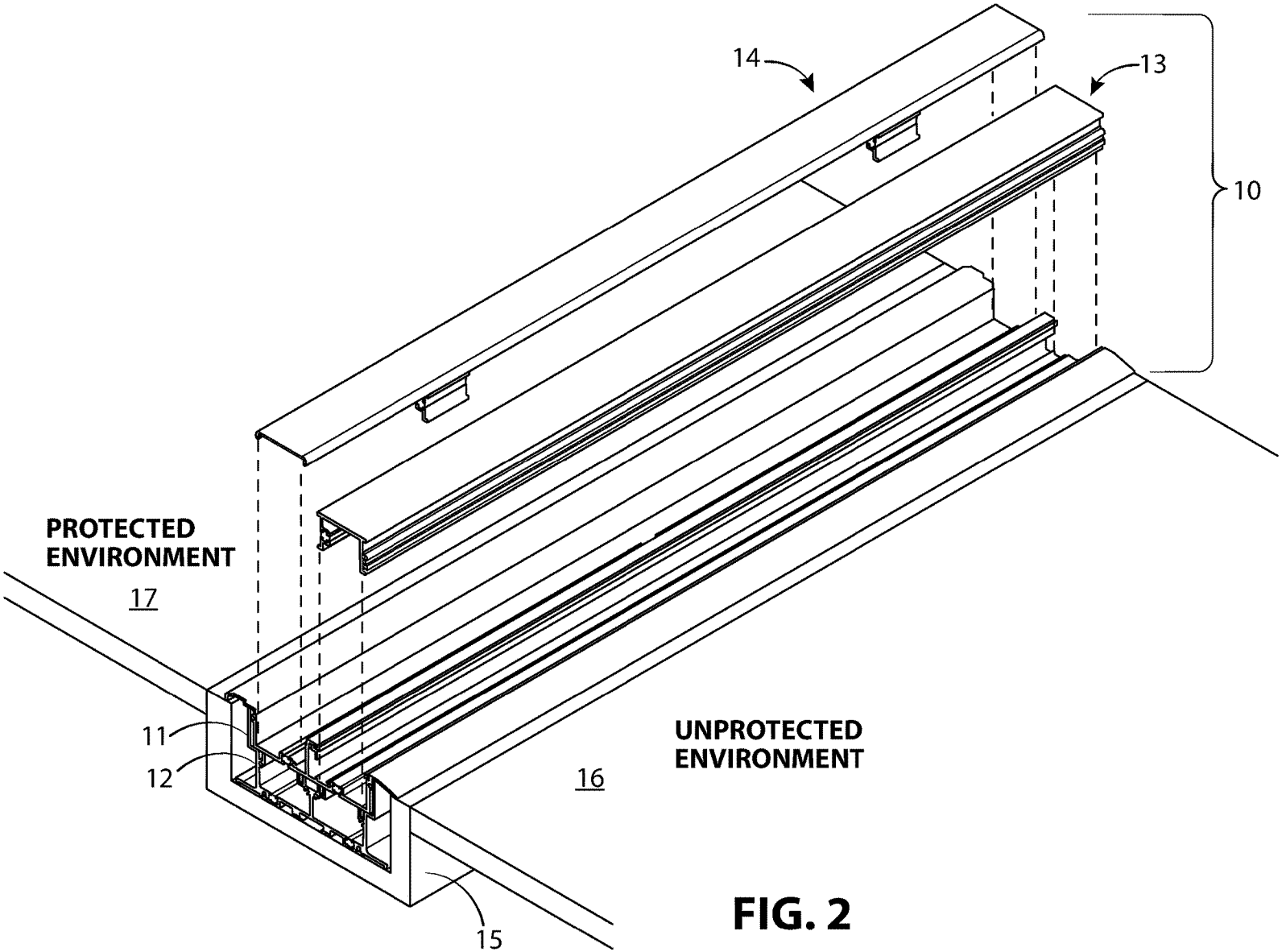
FIG. 2 illustrates a cutaway portion in top isometric view of the sill assembly of FIG. 1 within the typical installation environment.
Figure 3:
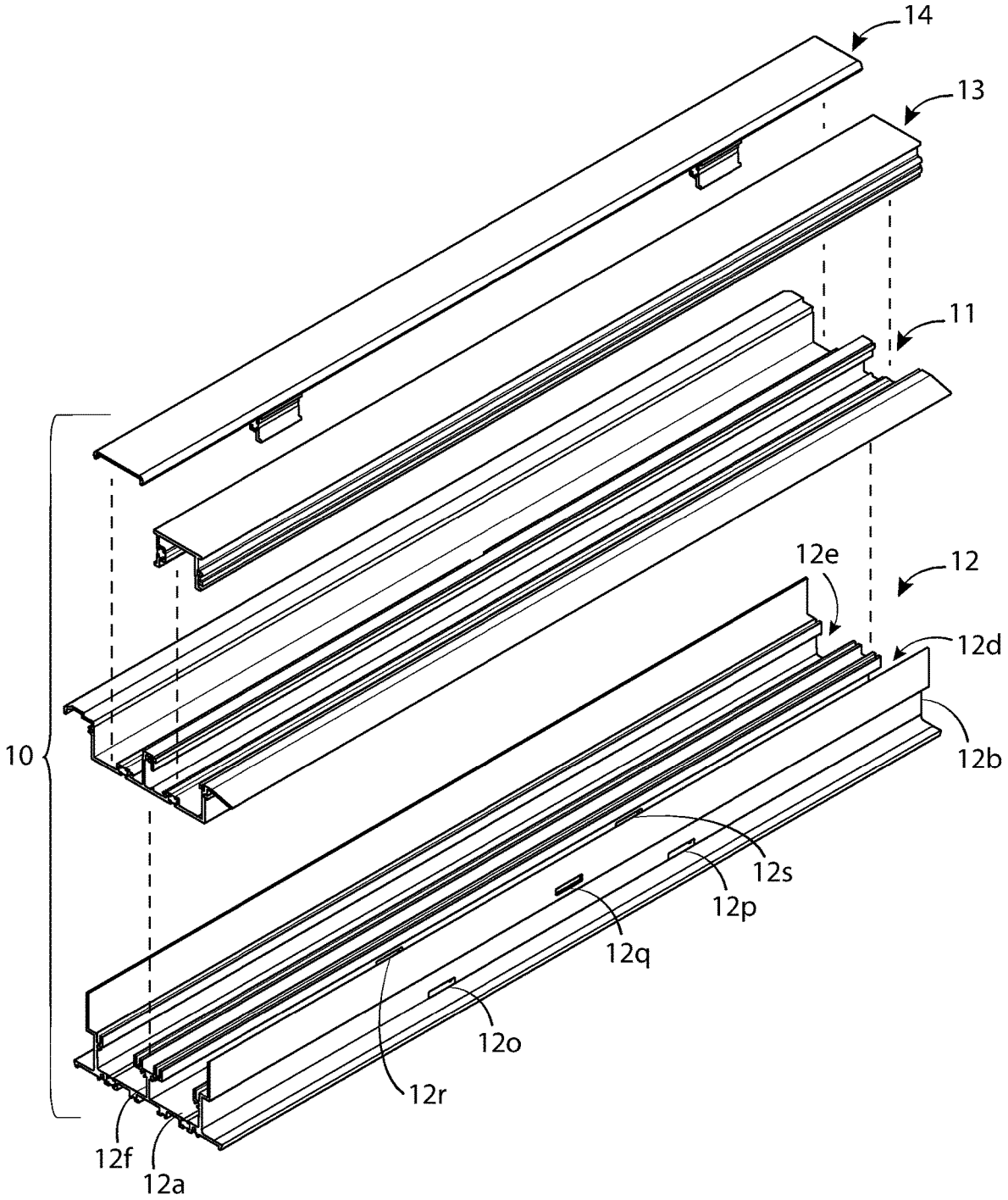
FIG. 3 illustrates a top isometric and exploded view of the cutaway portion of the sill assembly of FIG. 1.

Referring to FIGS. 1-3, the sill assembly 10 can include a sill 11, a subsill 12, or sill tank, a first threshold insert 13, and a second threshold insert 14. The sill 11, the subsill 12, the first threshold insert 13, and the second threshold insert 14, can be made of a variety of materials, for example, aluminum, steel, plastic, or fiberglass. Depending on the material, these components can be extruded, molded, cast, or otherwise formed.

Referring to FIGS. 1 and 2, the sill assembly 10 is shown mounted within a typical installation environment. In this example, the sill assembly 10 is mounted within a drain trough 15 and is nearly flush with the exterior floor 16 and interior floor 17. The exterior floor 16 and the interior floor 17 are illustrated as being level, i.e., lying in the same plane. While this is a typical installation environment suitable for meeting regulatory requirements such as ADA, or to create a nearly zero-threshold appearance for architecture or design aesthetics, the sill assembly 10 is not limited to the installation environment shown. For example, the sill assembly 10 can be mounted below grade without drain trough 15. Drain tube 19 of FIG. 1 can drain water into the unprotected environment directly or through gravel, drain rock, and/or through a French drain. For non-ADA applications, the sill can be mounted higher above the floor surface, or include a higher backstop to help increase performance.

Figure 4:
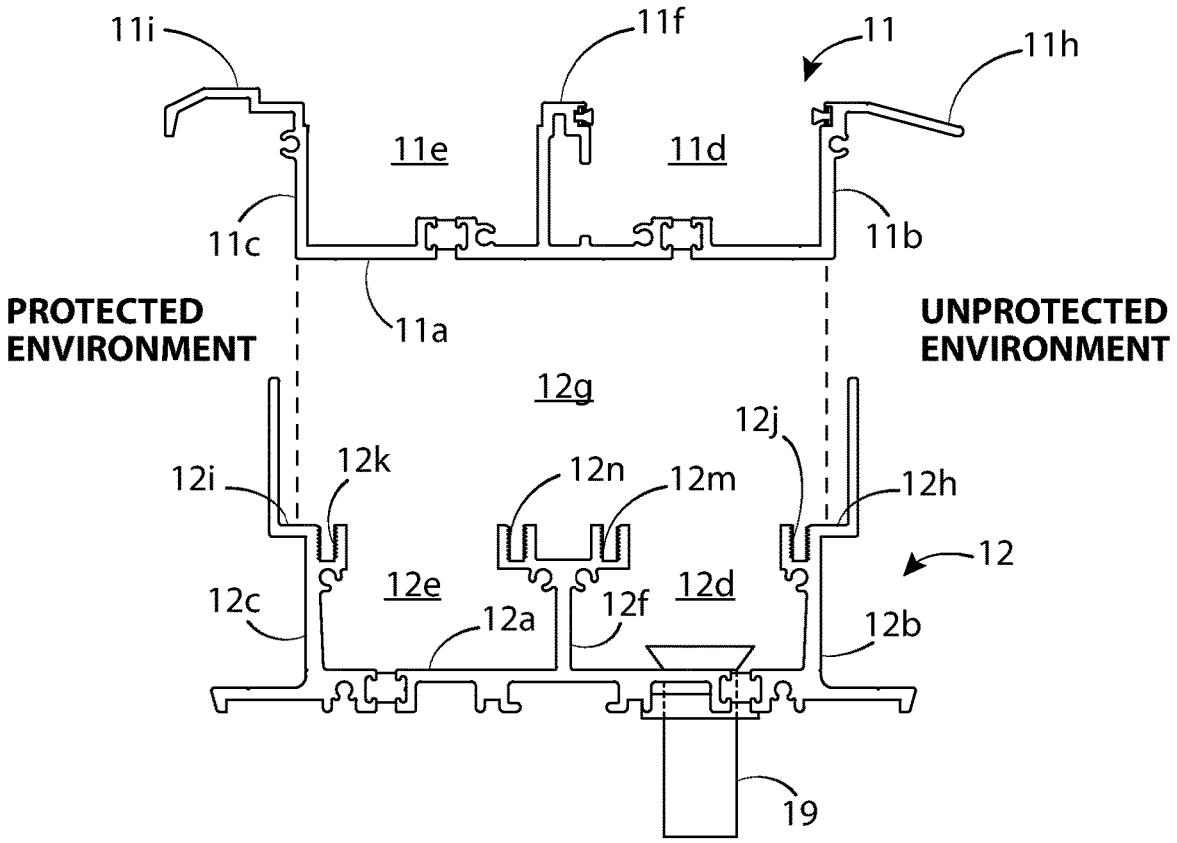
FIG. 4 illustrates a side and exploded view of the sill and subsill of the sill assembly of FIG. 1.

Referring to FIGS. 1 and 4, the sill 11 can have perimeter walls that include a sill bottom wall 11*a*, a first sill sidewall 11*b*, and a second sill sidewall 11*c*. The first sill sidewall 11*b* and the second sill sidewall 11*c* can extend directly upward from the sill bottom wall 11*a*. The first sill sidewall 11*b* faces the unprotected environment and the second sill sidewall 11*c* faces the protected environment. The sill 11 is shown divided into a first sill cavity 11*d* and a second sill cavity 11*e* by a sill upleg 11*f* that can project directly upward from the sill bottom wall 11*a* between the first sill sidewall 11*b* and the second sill sidewall 11*c*.

The subsill 12 can have perimeter walls that include a subsill bottom wall 12*a*, a first subsill sidewall 12*b*, a second subsill sidewall 12*c*. The first subsill sidewall 12*b* and the second subsill sidewall 12*c* can extend directly upward from the subsill bottom wall 12*a*. The first subsill sidewall 12*b* faces the unprotected environment and the second subsill sidewall 12*c* faces the protected environment. The subsill 12 can include a subsill upleg 12*f* that can project directly upward from the subsill bottom wall 12*a*. A first subsill cavity 12*d* is created between the first subsill sidewall 12*b* and the subsill upleg 12*f*. A second subsill cavity 12*e* is formed between the second subsill sidewall 12*c* and the subsill upleg 12*f*.

Referring to FIG. 4, an upper subsill cavity 12*g* is formed in the region above the subsill upleg 12*f* between the first subsill sidewall 12*b* and the second subsill sidewall 12*c*. The sill 11 can include sill flanges that extend outward from the sill 11 in opposite directions. For example, the sill 11 can include a first sill flange 11*h* that extends outward from the top of the first sill sidewall 11*b* and a second sill flange 11*i* that extends outward from the second sill sidewall 11*c*. The subsill 12 and sill 11 can be sized and shaped so that the subsill 12 receives the sill partially within the upper subsill cavity 12*g*.

Figure 5:
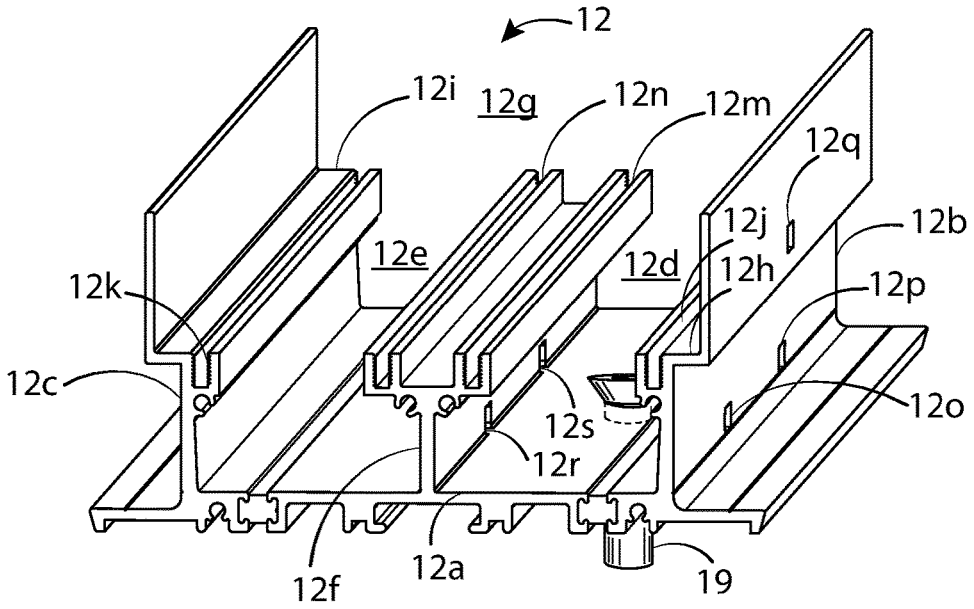
FIG. 5 illustrates a side and top isometric view of the subsill of the sill assembly of FIG. 1.

For example, referring to FIGS. 4 and 5, the first subsill sidewall 12*b* and the second subsill sidewall 12*c* can step out and form a first ledge 12*h* and second ledge 12*i*, respectively. Referring to FIG. 4, the first ledge 12*h* and the second ledge 12*i* together along with the top of the subsill upleg 12*f* form seating surfaces for the sill bottom wall 11*a*. Referring to FIGS. 4 and 5, the first ledge 12*h*, the second ledge 12*i*, top of the subsill upleg 12*f*, the first subsill sidewall 12*b*, and the second subsill sidewall 12*c* can form the upper subsill cavity 12*g* that receives and seats the sill 11 of FIG. 4. The sill 11 of FIG. 4 can be secured to the subsill 12 by threaded fasteners extending through the sill 11 and threadably engaging grooved channels 12*j*, 12*k* extending from the first subsill sidewall 12*b* and the second subsill sidewall 12*c*, respectively as well threadably engaging grooved channels 12*m*, 12*n* positioned at the top of the subsill upleg 12*f*.

Referring to FIG. 1, with the sill assembly 10 assembled, the first sill cavity 11*d*, the first subsill cavity 12*d*, the second sill cavity 11*e*, and the second subsill cavity 12*e* form pressure chambers. The first sill cavity 11*d* is aligned over the first subsill cavity 12*d* and can be positioned within the unprotected environment. In addition, the operable door is mounted over the first sill cavity 11*d* and the first subsill cavity 12*d* as illustrated in FIGS. 14, 15, 17, 18, and 21. Continuing to refer to FIG. 1, the second sill cavity 11*e* can be aligned over the second subsill cavity 12*e* and can be positioned within the protected environment. The first subsill cavity 12*d* can form a first vertically-stacked pressure chamber pair. In that instance, the first threshold insert 13, the first sill cavity 11*d*, and the first subsill cavity 12*d* are positioned over the door and within the unprotected environment. The operable door divides the protected environment from the unprotected environment. One pressure chamber of the pair comprises the first threshold insert 13 and the first sill cavity 11*d*. The other pressure chamber of the pair comprises the first subsill cavity 12*d* enclosed by the sill bottom wall 11*a*. The second threshold insert 14, the second sill cavity 11*e*, and the second subsill cavity 12*e*, aligned within the protected environment form a second vertically-stacked pressure chamber pair. The first pressure chamber of the pair comprises the second threshold insert 14 and the second sill cavity 11*e*. The second pressure chamber of the pair comprises the second subsill cavity 12*e* enclosed by the sill bottom wall 11*a*.

Figure 6:
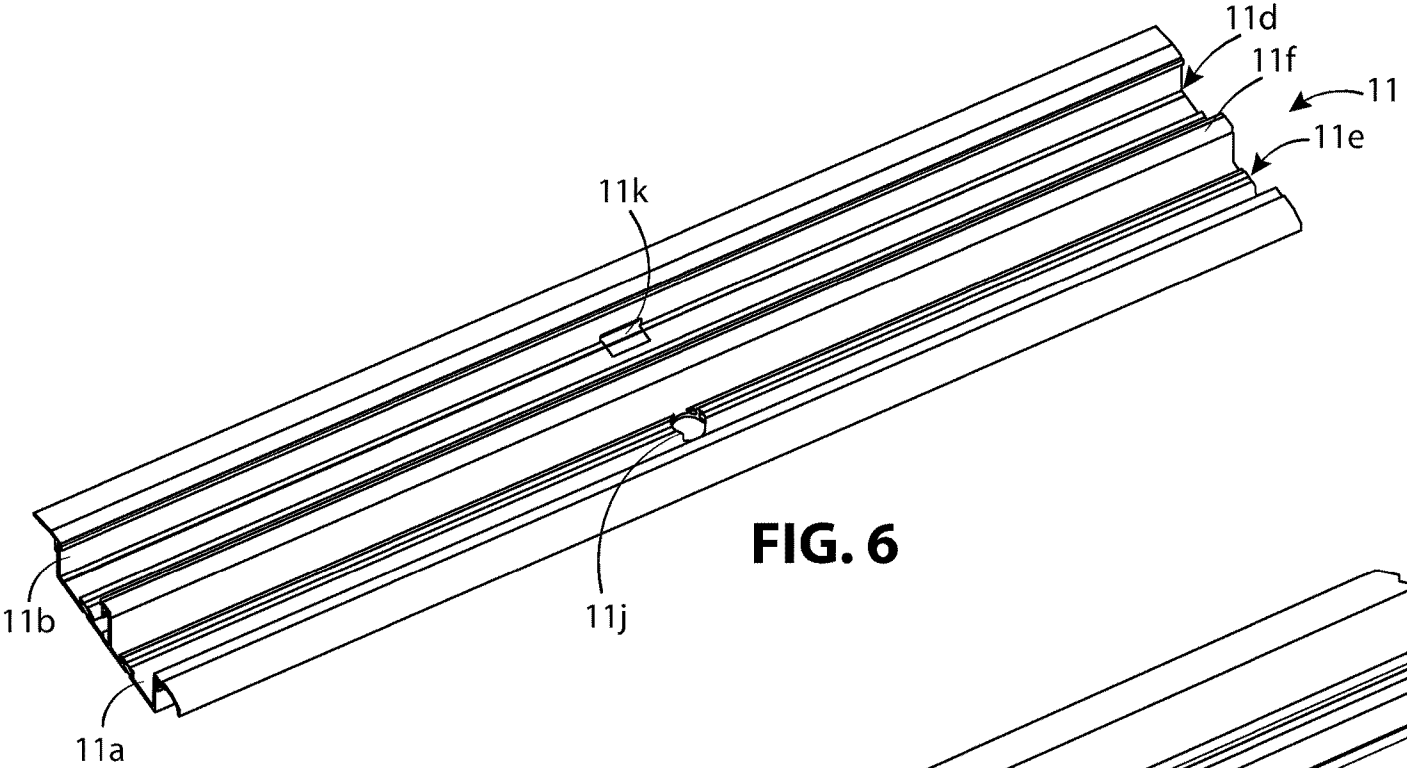
FIG. 6 illustrates a top isometric view of the sill of the sill assembly of FIG. 1 looking from back to front.
Figure 7:
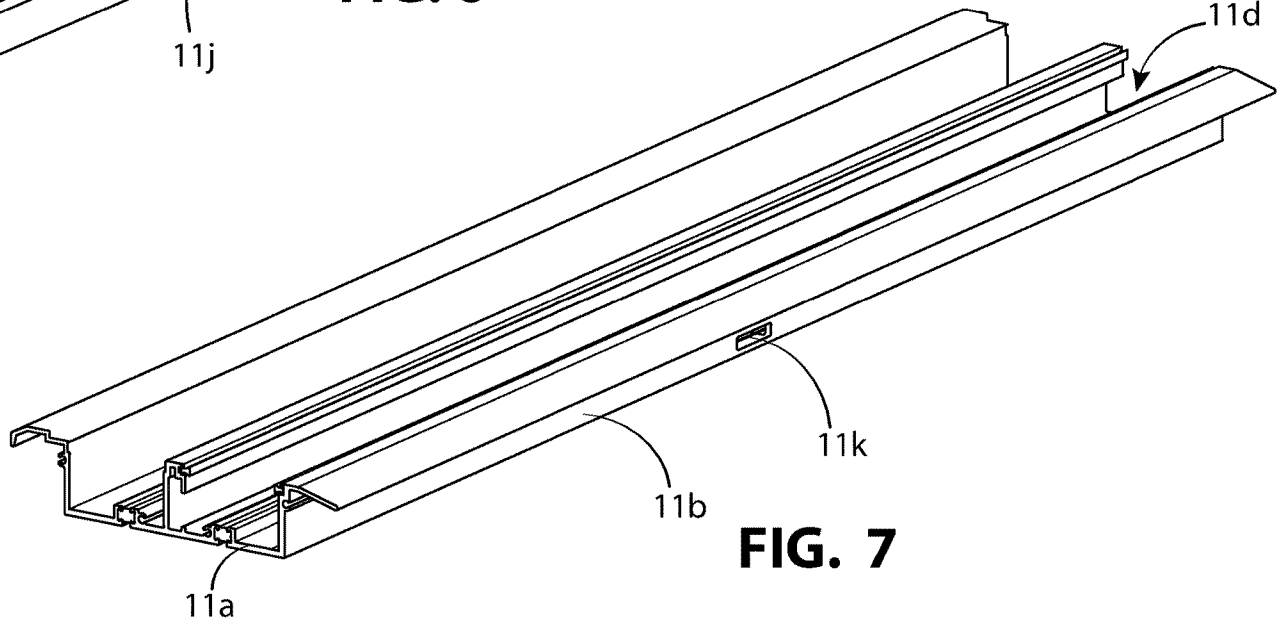
FIG. 7 illustrates a top isometric view of the sill of the sill assembly of FIG. 1 looking from front to back.

Referring to FIG. 6 the sill upleg 11*f* isolates the first sill cavity 11*d* from the second sill cavity 11*e*. An aperture 11*j* can extend through the sill bottom wall 11*a* from within the second sill cavity 11*e* of the sill 11. Referring to FIGS. 6 and 7, the first sill cavity 11*d* can include a weep hole 11*k* located through the first sill sidewall 11*b* proximate to the sill bottom wall 11*a*. The weep hole can optionally include a weep flap that allows water to flow out of the first sill cavity, but prevents water from flowing back into the sill cavity from the unprotected environment.

Figure 9:
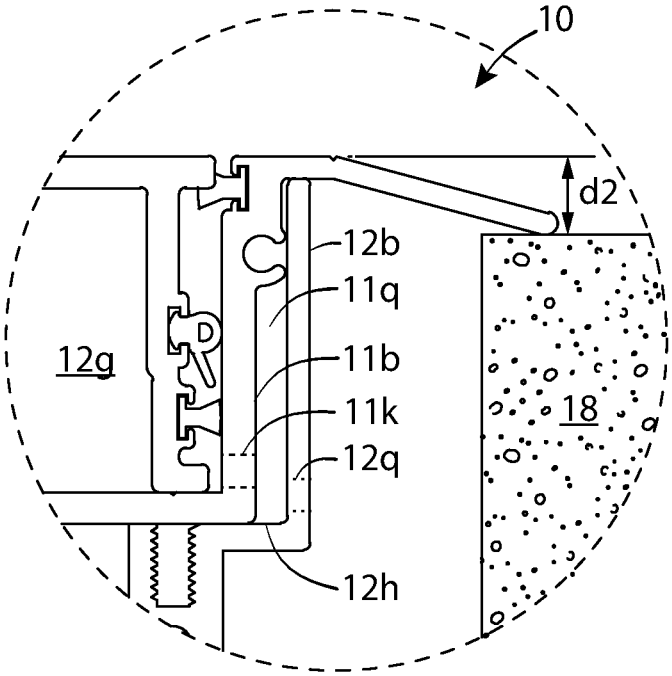
FIG. 9 illustrates an exterior-facing portion of FIG. 1, enlarged for magnification.

Referring to FIGS. 3 and 5, the subsill can include lower weep holes 12*o*, 12*p* located proximate through the first subsill sidewall 12*b* proximate to the subsill bottom wall 12*a*. Referring to FIG. 1, these are typically equipped with weep flaps 18 to prevent backflow of water back into the first subsill cavity 12*d*. Referring to FIGS. 3 and 5, the subsill 12 can include an upper weep hole 12*q* through the first subsill sidewall 12*b* adjacent to the upper subsill cavity 12*g* of FIG. 4. Referring to FIG. 9, shows the weep hole 11*k* in the first sill sidewall 11*b* in relation to the upper weep hole 12*q*. A small pressure chamber is formed within the third sill cavity 11*q* can within the upper subsill cavity 12*g* between the first sill sidewall 11*b* and the first subsill sidewall 12*b* and above the first ledge 12*h*.

Referring to FIGS. 4 and 5, the subsill 12 can optionally use a drain tube 19 positioned through the subsill bottom wall 12*a* to drain accumulated water directly out of the subsill from below. The drain tube 19 can include a ball valve (i.e. a floating ball valve to prevent back flow) or other anti-back flow mechanism to prevent water from flowing back into the subsill 12 through the drain tube 19.

Referring to FIGS. 3 and 5, the subsill upleg 12*f* can include apertures, such as the apertures 12*r*, 12*s*, to allow drainage of any water infiltration from the protected environment into the unprotected environment. Apertures 12*r*, 12*s* can optionally include one-way valves to allow water to drain from the second subsill cavity 12*e* to the first subsill cavity 12*d* without flowing back into the second subsill cavity 12*e*.

Figure 8:
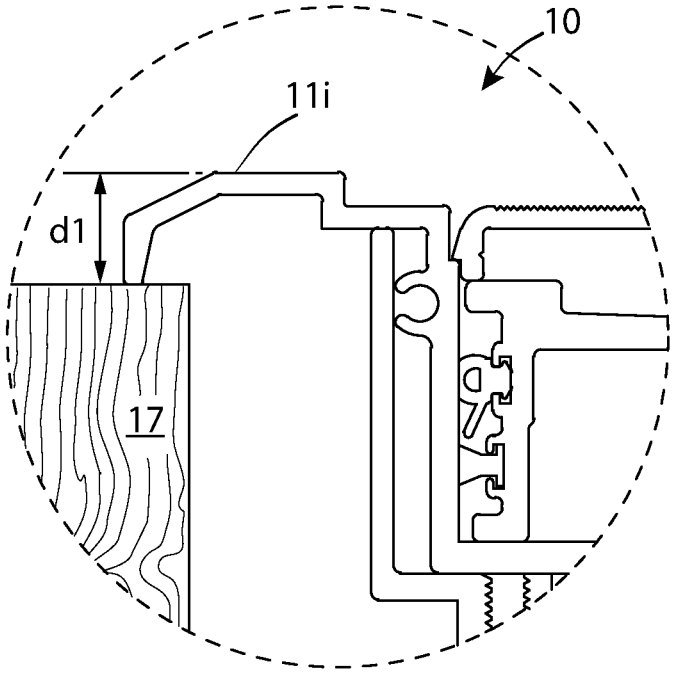
FIG. 8 illustrates an interior-facing portion of FIG. 1, enlarged for magnification.

Referring to FIGS. 8 and 9, the second sill flange 11*i* (FIG. 8) can act as a backstop for the sill assembly 10. The height of the second sill flange 11*i* is d1 above the interior floor 17. The height of the first sill flange 11*h* is d2 above the exterior floor 16. This gives an effective backstop height of d1-d2. For a sill assembly that is ADA compliant, the sill assembly 10 cannot be higher than from 0.5 inches (0.0127 meters) above the interior floor 17 or the exterior floor 16. The means that for the sill assembly to comply with ADA d1≤0.5 inches. For non-ADA applications d1 can be much higher. This can give a greater effective backstop height.

Figure 10:
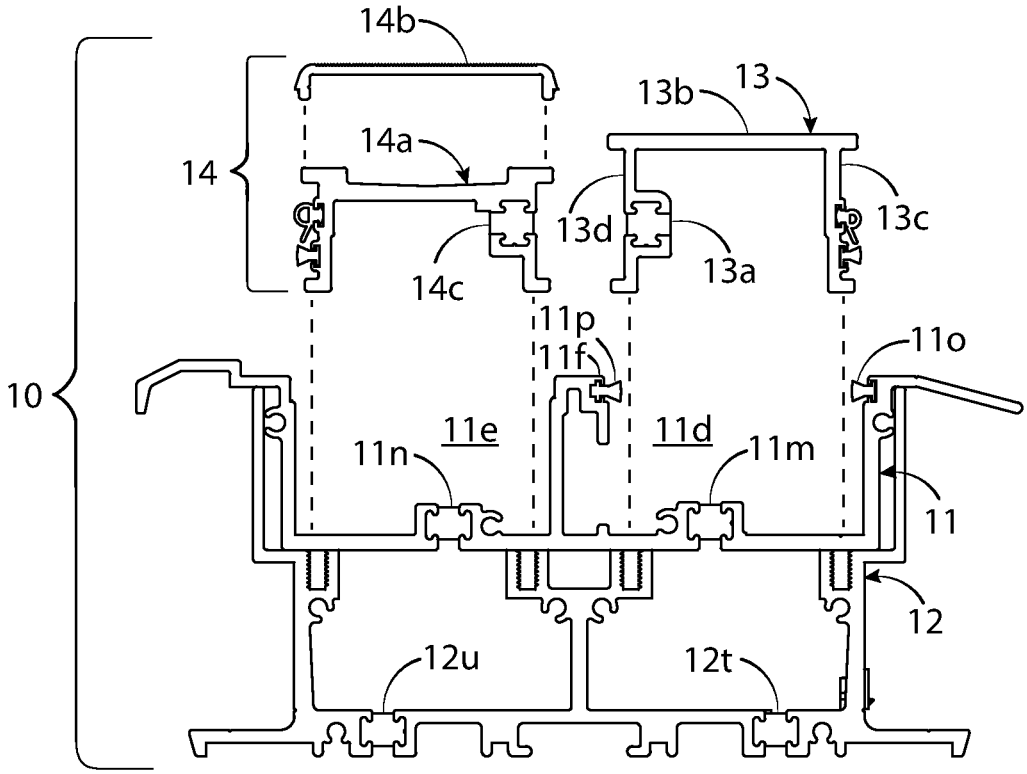
FIG. 10 illustrates a side view of the sill and subsill of FIG. 1 with threshold inserts for a swing door exploded away from the sill and subsill.
Figure 11:
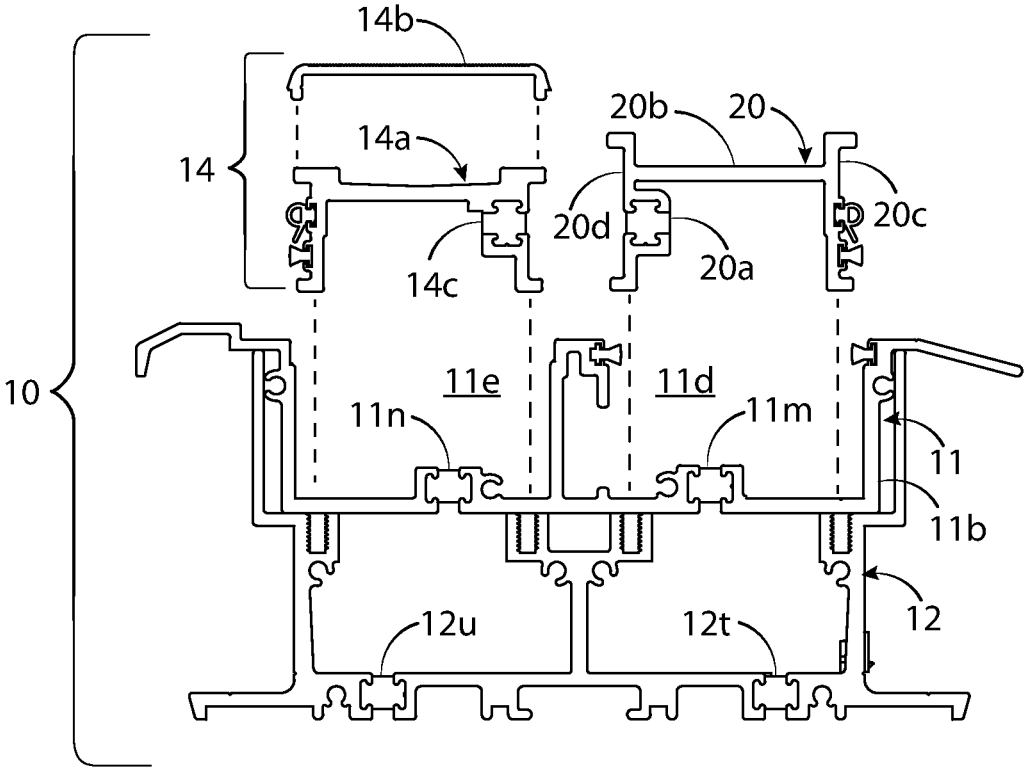
FIG. 11 illustrates a side view of the sill and subsill of FIG. 1 with threshold inserts for a pivot door exploded away from the sill and subsill.
Figure 12:
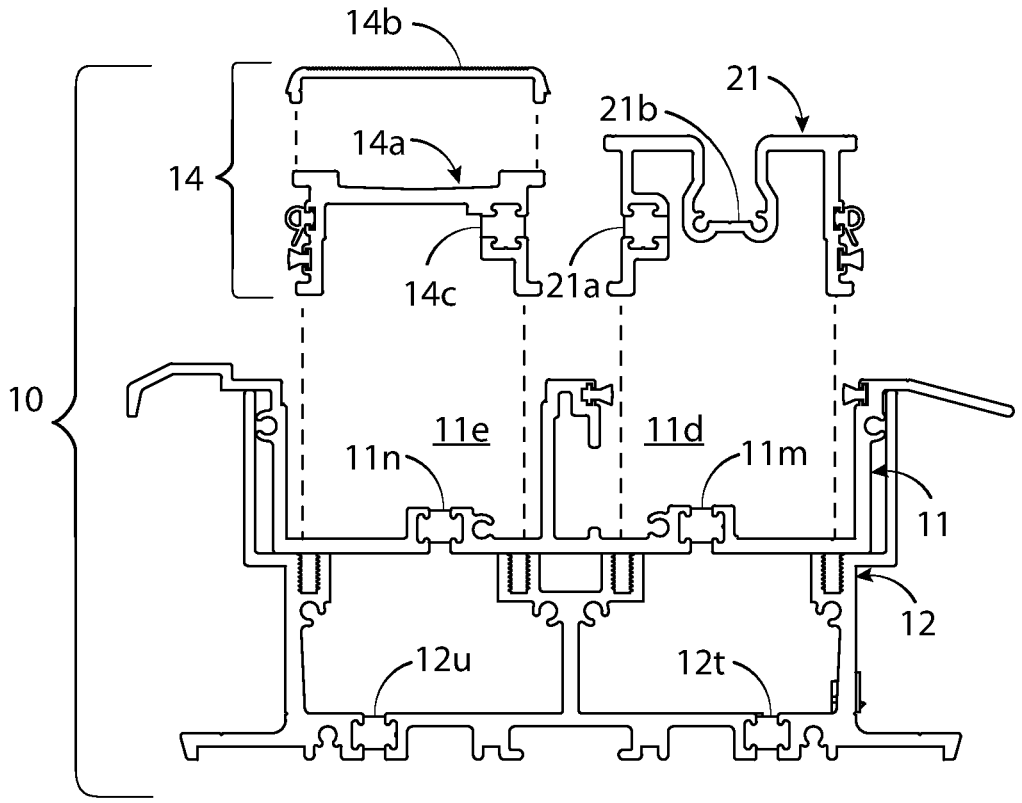
FIG. 12 illustrates a side view of the sill and subsill of FIG. 1 with threshold inserts for a folding door exploded away from the sill and subsill.

The sill assembly of FIG. 1 can accommodate different door types by changing the first threshold insert 13 and/or the second threshold insert 14. The sill 11 and subsill 12, without modification, can be used with different door types. For example, the sill 11 and the subsill 12 are the same for the sill assembly 10 of FIGS. 10-14. However, by virtue of different threshold inserts, the sill assembly 10 of FIGS. 10, 11, 12, and 13 can accommodate different door types including a swing door, a pivot door, a folding door, and a sliding door, respectively. FIGS. 10, 11, and 12 illustrate the same threshold insert, second threshold insert 14. The second threshold insert 14 is aligned over and can be mounted within the second sill cavity 11*e*. The second threshold insert 14 forms a second top surface of the sill 11 and sill assembly 10. Second threshold insert 14 can include a threshold insert body 14*a* and a threshold insert cover 14*b*. The threshold insert cover 14*b* as illustrated, can be substantially flat (i.e., planar) but can include texturing or ribbing. The threshold insert cover 14*b* typically snaps into place over the threshold insert body 14*a*. The outside surface of the threshold insert cover 14*b* can form a second top surface the sill 11 and the sill assembly 10.

Figure 14:
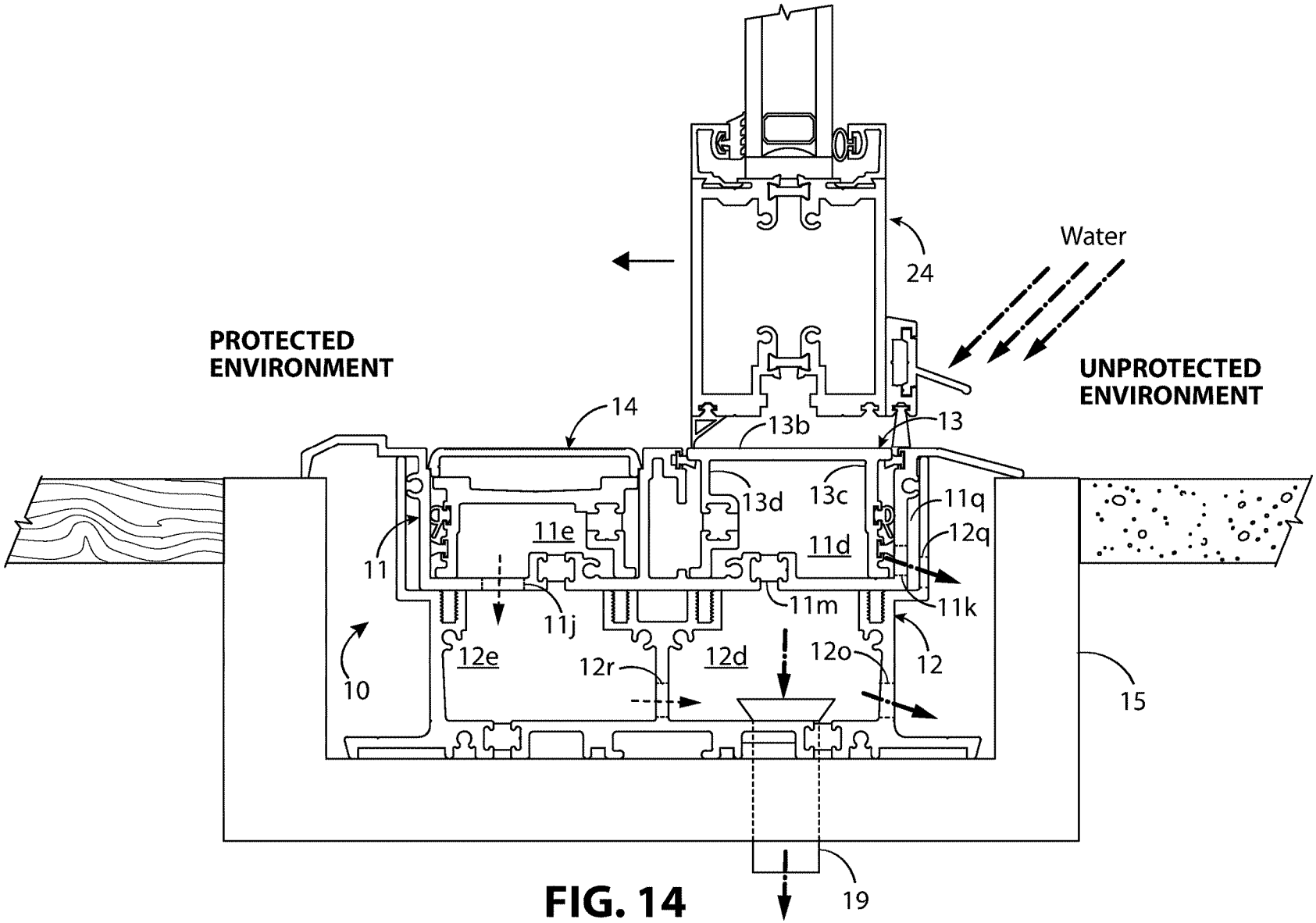
FIG. 14 illustrates the sill assembly of FIG. 1 installed in a typical installation environment, with the threshold inserts configured to receive a swing door with a portion of an inswing door shown.
Figure 15:
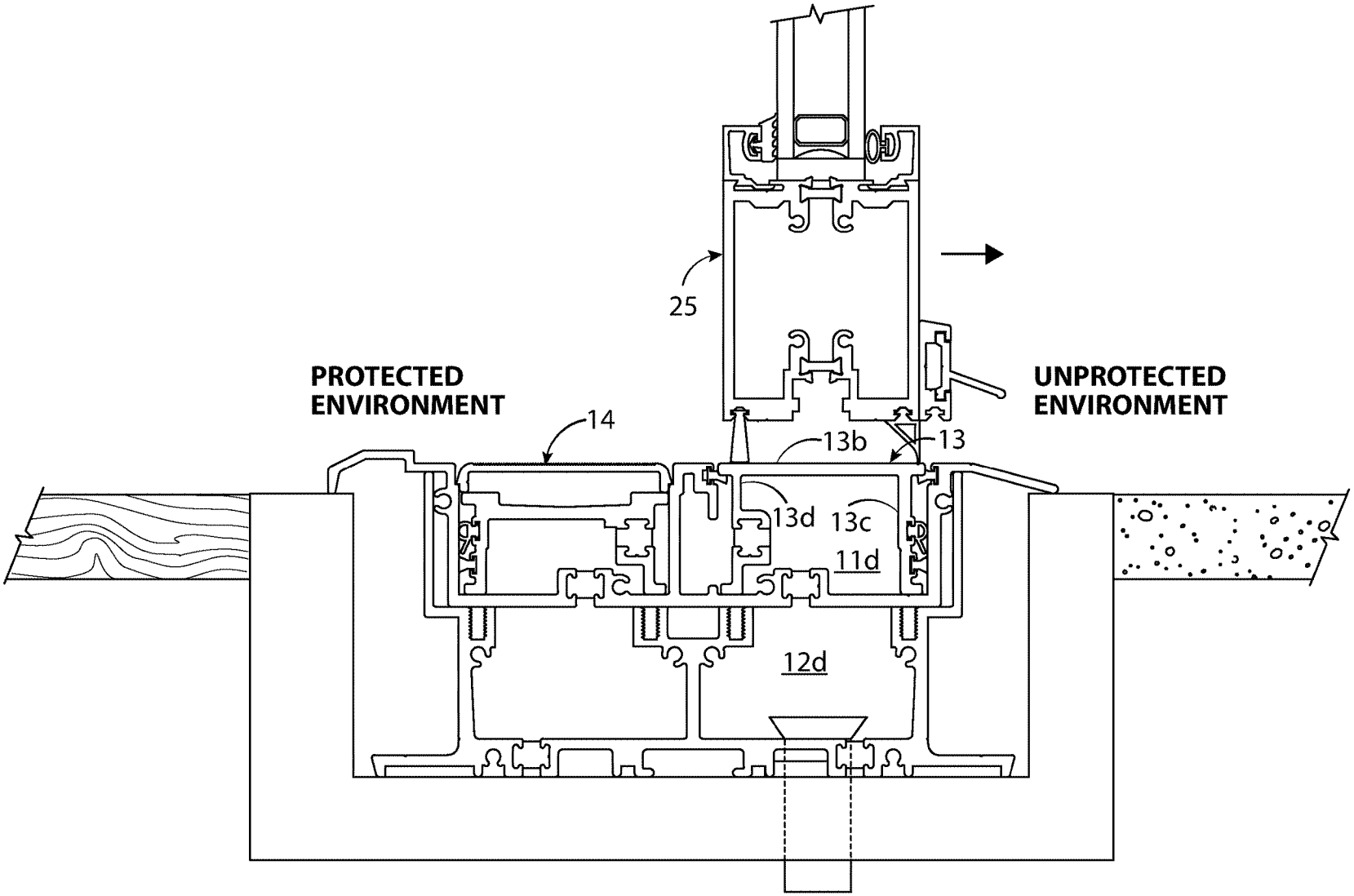
FIG. 15 illustrates the sill assembly of FIG. 1 installed in a typical installation environment, with the threshold inserts configured to receive a swing door with a portion of an outswing door shown.
Figure 16:
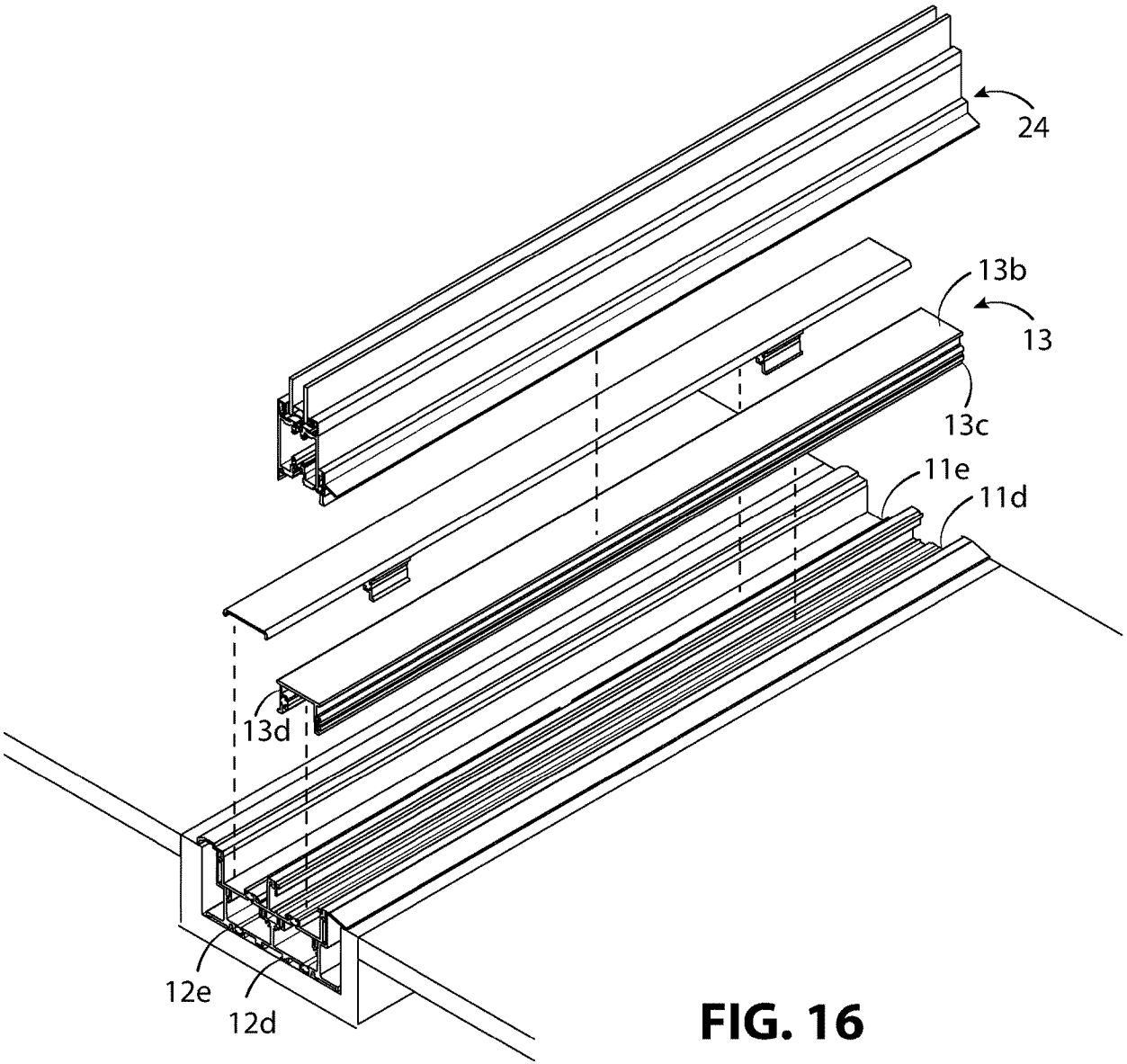
FIG. 16 illustrates an isometric of FIG. 15 with the threshold inserts and the portion of the outswing door exploded away from the sill assembly and the environment.

Referring to FIG. 10 the first threshold insert 13 in this figure is configured to be used with a swing door. The first threshold insert 13 is aligned over and mounted within the first sill cavity 11*d*. This can be an inswing door 24, a portion of which is shown in FIGS. 14 and 16, or an outswing door 25, a portion of which is shown in FIG. 15. Referring to FIGS. 10 and 14-16, the first threshold insert 13 includes a threshold top 13*b* that can have a substantially flat top surface (i.e. substantially planar). The outside-facing surface of the threshold top 13*b* can form a first top surface of the sill 11 and sill assembly 10. The threshold top 13*b* extends horizontally outward past the threshold sides 13*c*, 13*d* creating an overhang. Referring to FIG. 10, this creates a partial seal with gaskets 11*o*, 11*p* that extend along the length of the first sill sidewall 11*b* and the sill upleg 11*f*, respectively. Referring to FIGS. 14 and 16, the inswing door 24 is aligned over the first threshold insert 13, the first sill cavity 11*d*, and the first subsill cavity 12*d*. Referring to FIG. 14, the top surfaces of the first threshold insert 13 and the second threshold insert 14 can be substantially flat and lie in the same plane. This helps facilitate the inswing door 24 to open. Similarly, in FIG. 15, the outswing door 25 is aligned over the first threshold insert 13, the first sill cavity 11*d*, and the first subsill cavity 12*d*. This arrangement routes water from the unprotected environment into the first sill cavity 11*d*, the first subsill cavity 12*d*, and drains the water out of the system through weep holes, weep flaps, and/or drain tubes. The water stays out of the protected environment.

FIG. 14 shows air and water paths through the sill assembly 10.

While this is shown with a swing door, this discussion also applies to sill assembly 10 using the pivot door 26 (FIG. 17), the folding door 27 (FIG. 18), and the sliding door 28 (FIG. 21) because the sill 11 and the subsill 12 remain the same. Referring to FIG. 14, a simplified typical water path is represented by arrowed thick dash-dot-dash lines. A simplified typical air path is represented by a thinner arrowed dashed line. As illustrated, water can enter under the door. Water can flow through the partial seals between the first threshold insert 13 and the sill 11. When the sill upleg 11*f* is formed with the sill 11 itself, for example, by extrusion, casting, or molding, depending on the material, there is a leak-proof barrier between the first sill cavity 11*d* and the second sill cavity 11*e*. Any water entering the first sill cavity 11*d* will drain out through weep hole 11*k* or may leak through the thermal break 11*m*. Water draining through weep hole 11*k* enters a small pressure chamber formed by a third sill cavity 11*q* between the sidewalls of the sill 11 and subsill 12 as illustrated. This water may further drain out an upper weep hole 12*q*. The upper weep hole 12*q* may optionally have a weep flap to prevent water from between the subsill and the drain trough 15 from reentering the sill assembly 10. Any remaining water that finds its way from between the sill 11 and subsill 12 into first subsill cavity 12*d*, will drain out through either the lower weep hole 12*o* or through the drain tube 19. The lower weep hole 12*o* can optionally include a weep flap to keep water from flowing back into the sill assembly 10.

Air flows in from the protected environment into the second sill cavity 11*e*. Air then flows through aperture 11*j* and into the second subsill cavity 12*e* and through aperture 12*r*. This creates a pressure head to improve drainage performance. In addition, any water accumulating in the second subsill cavity 12*e* can drain out through aperture 12*r*. To prevent backflow of water from the first subsill cavity 12*d* into the second subsill cavity 12*e*, aperture 12*r* can optionally include a one-way valve. Aperture 11*j* can help limit bubbling of water. Bubbling typically can affect performance. The aperture 11*j* can be adjusted to optimize water flow and suppression of bubbling depending on the size and shape of the sill.

Typically, ADA-type sills do not perform well under driving rains, especially ADA sills for sliding doors. A version of the sill assembly 10 of the present disclosure using a sliding glass door assembly similar to FIG. 21 was tested for resistance to water penetration. The door assembly included one stationary door and one operable door. In this case, the operable door was a sliding door. The unit was tested by National Certified Testing Laboratories in York, Pa. for water penetration by uniform static air pressure difference under ASTM E331 and by cyclic static air pressure difference under ASTM E547. The test unit showed no water leakage at 15 psf (718.2 Pa) at 5.0 gph/ft$^2$ (146.7 m s), which greatly exceeded performance expectations for a sliding door with an ADA sill.

Figure 17:
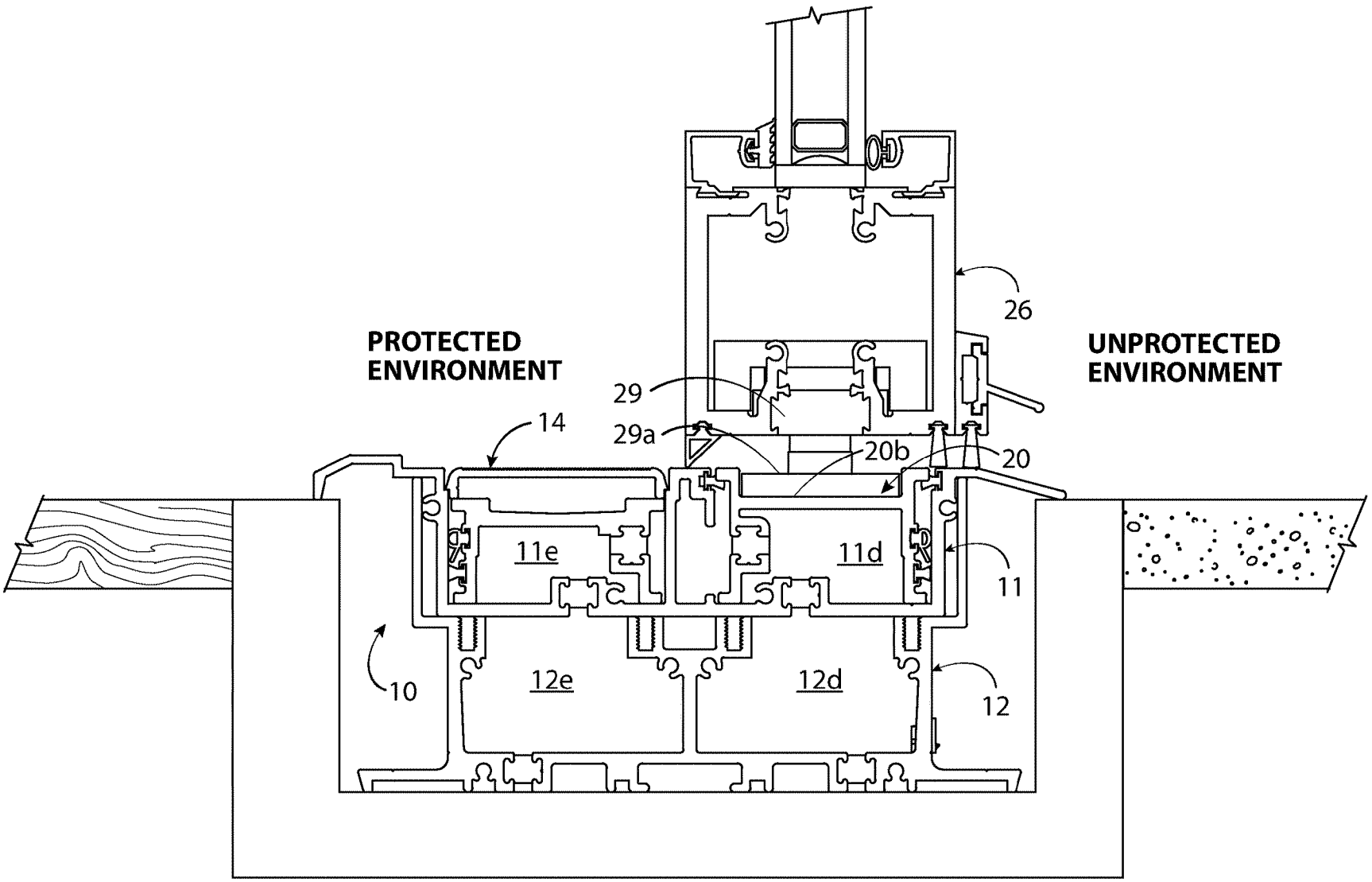
FIG. 17 illustrates a side elevation view of the sill assembly of FIG. 1 installed in a typical installation environment, with the threshold inserts configured to receive a pivot door with a portion of the pivot door shown.
Figure 19:
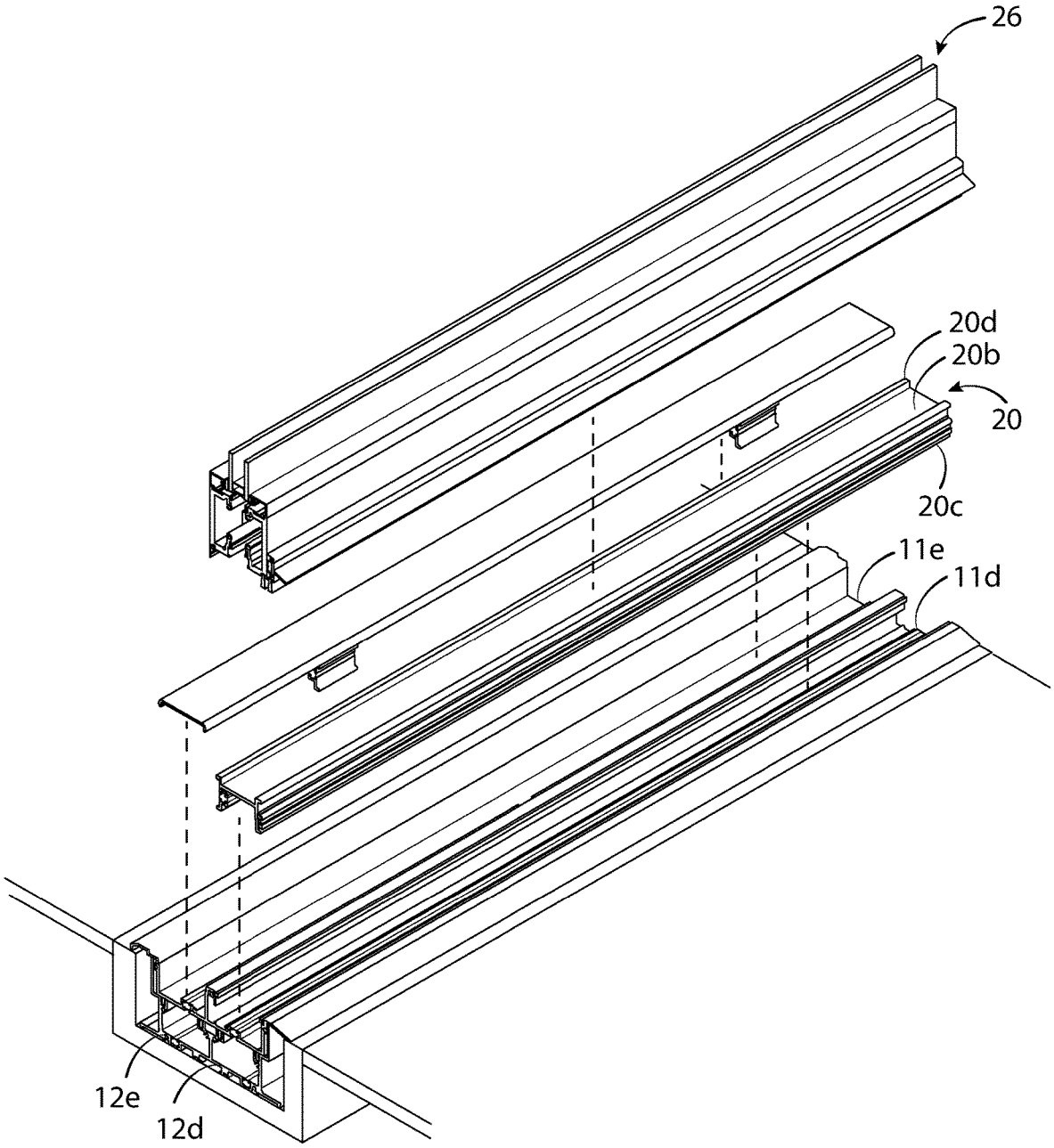
FIG. 19 illustrates an isometric view of FIG. 17 with the threshold inserts and the portion of the pivot exploded away from the sill assembly and the environment.

FIGS. 11 and 17 illustrate the sill assembly 10 adapted for use with a pivot door by simply replacing other first threshold inserts mounted within the first sill cavity 11*d*. The first threshold insert 20 is aligned over and mounted within the first sill cavity 11*d*. The first threshold insert 20 can form a first top surface of the sill 11 and can form a first top surface of the sill assembly 10. The second threshold insert 14 is aligned over and can be mounted within the second sill cavity 11*e*. The second threshold insert 14 forms a second top surface of the sill 11. Referring to FIGS. 11 and 19, the first threshold insert 20 includes a threshold top wall 20*b* that is recessed from the first threshold sidewalls 20*c*, 20*d*. The threshold top wall 20*b* can form the first top surface of the sill 11 (FIG. 11) and the sill assembly 10. Referring to FIG. 17, the threshold top wall 20*b* is sized and shaped to receive the base 29*a* of the pivot mechanism 29 attached to the pivot door 26. Referring to FIGS. 17 and 19, the pivot door 26 is aligned over the first sill cavity 11*d* and the first subsill cavity 12*d*. The principle of operation of water drainage and air flow can be the same or similar to what was described for FIG. 14. The first sill cavity 11*d* and the first subsill cavity 12*d* can form a first vertically-stacked pressure chamber pair within the unprotected environment. The second sill cavity 11*e* and the second subsill cavity 12*e* can form a second vertically-stacked pressure chamber pair within the protected environment.

Figure 18:
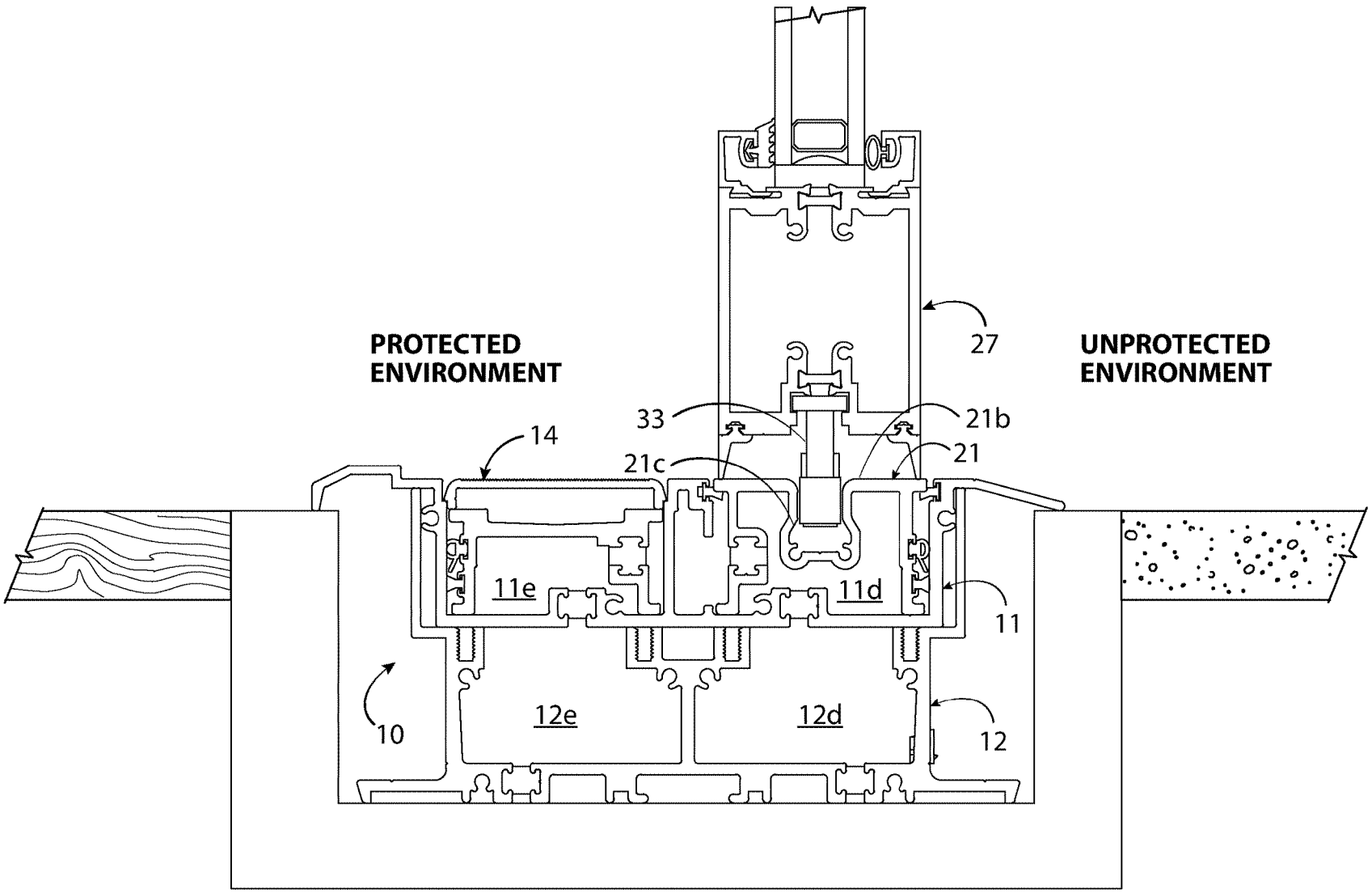
FIG. 18 illustrates a side elevation view of the sill assembly of FIG. 1 installed in a typical installation environment, with the threshold inserts configured to receive a folding door with a portion of the folding door shown.
Figure 20:
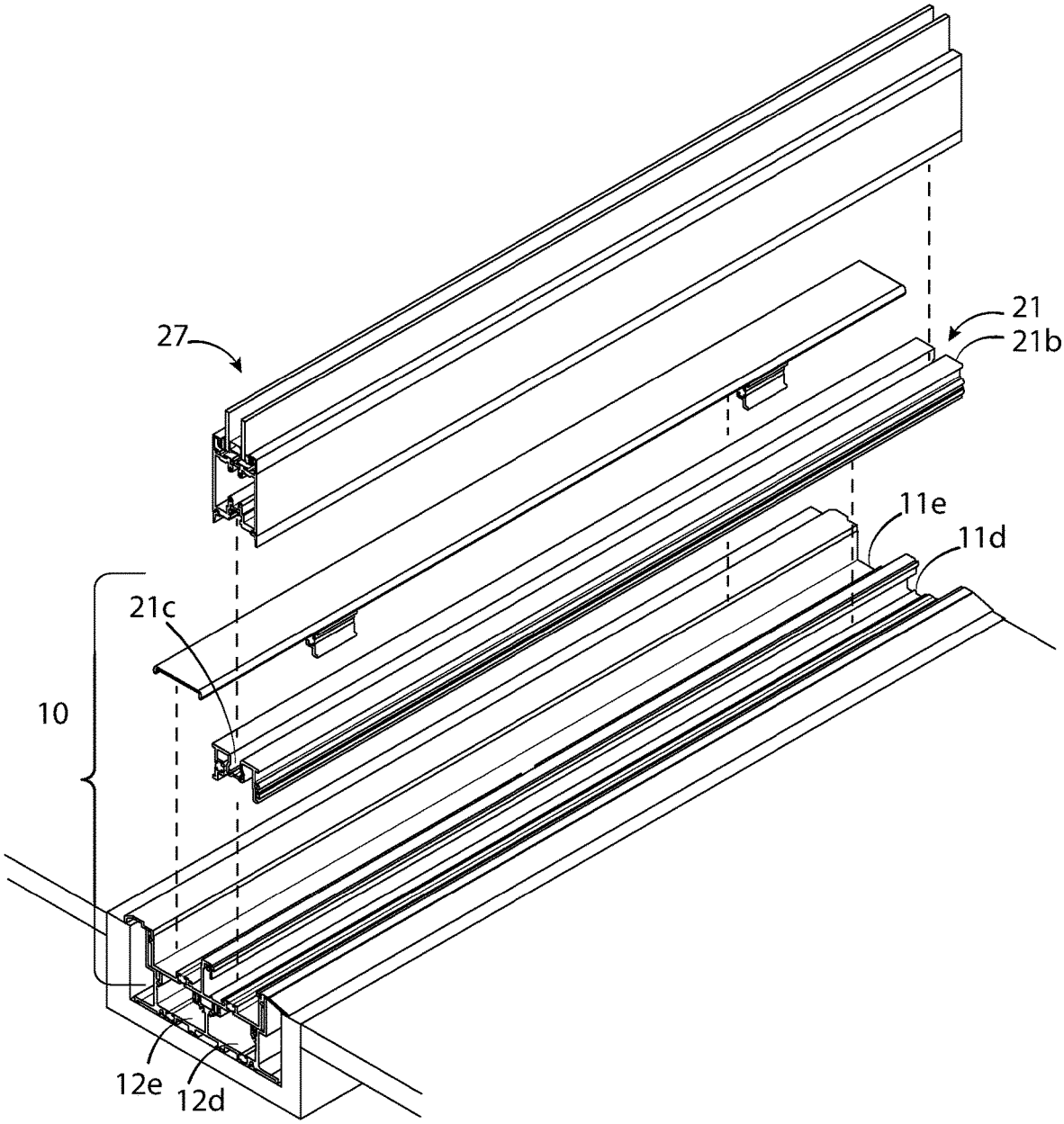
FIG. 20 illustrates an isometric view of FIG. 18 with the threshold inserts and the portion of the folding exploded away from the sill assembly and the environment.

FIGS. 12, 18, and 20 illustrate the sill assembly 10 adapted for use with a folding door by simply replacing other first threshold inserts with the first threshold insert 21. The first threshold insert 21 is aligned over and mounted within the first sill cavity 11*d*. The first threshold insert 21 can form a first top surface of the sill 11 and can form a first top surface of the sill assembly 10. As before, the second threshold insert 14 is aligned over and can be mounted within the second sill cavity 11*e*. The second threshold insert 14 can form a second top surface of the sill 11 and the sill assembly 10. Referring to FIGS. 12, 18 and 20, the first threshold insert 21 includes a threshold top wall 21*b* with a blind hole 21*c*. Referring to FIG. 18, the blind hole 21*c* is sized and shaped to receive the pivot mechanism 33 attached to the folding door 27. Referring to FIGS. 18 and 20, the folding door 27 is aligned over the first sill cavity 11*d* and the first subsill cavity 12*d*. The principle of operation of water drainage and air flow can be the same or similar to what was described for FIG. 14. The first sill cavity 11*d* and the first subsill cavity 12*d* can form a first vertically-stacked pressure chamber pair within the unprotected environment. The second sill cavity 11*e* and the second subsill cavity 12*e* can form a second vertically-stacked pressure chamber pair within the protected environment.

Figure 13:
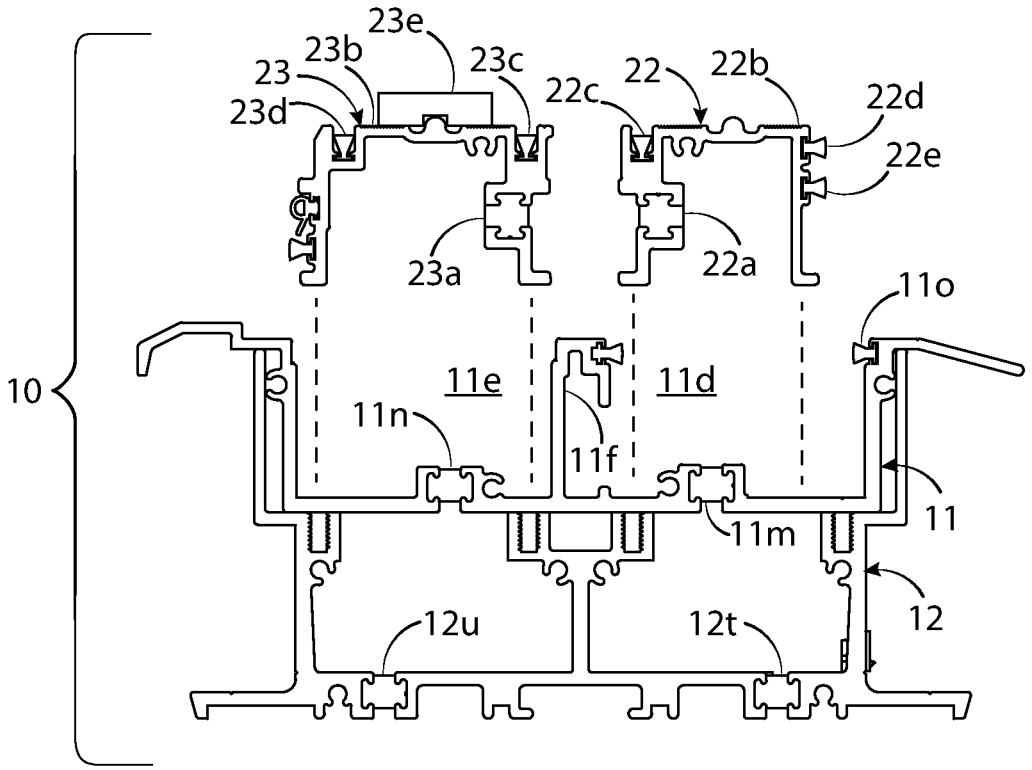
FIG. 13 illustrates a side view of the sill and subsill of FIG. 1 with threshold inserts for a sliding door exploded away from the sill and subsill.
Figure 21:
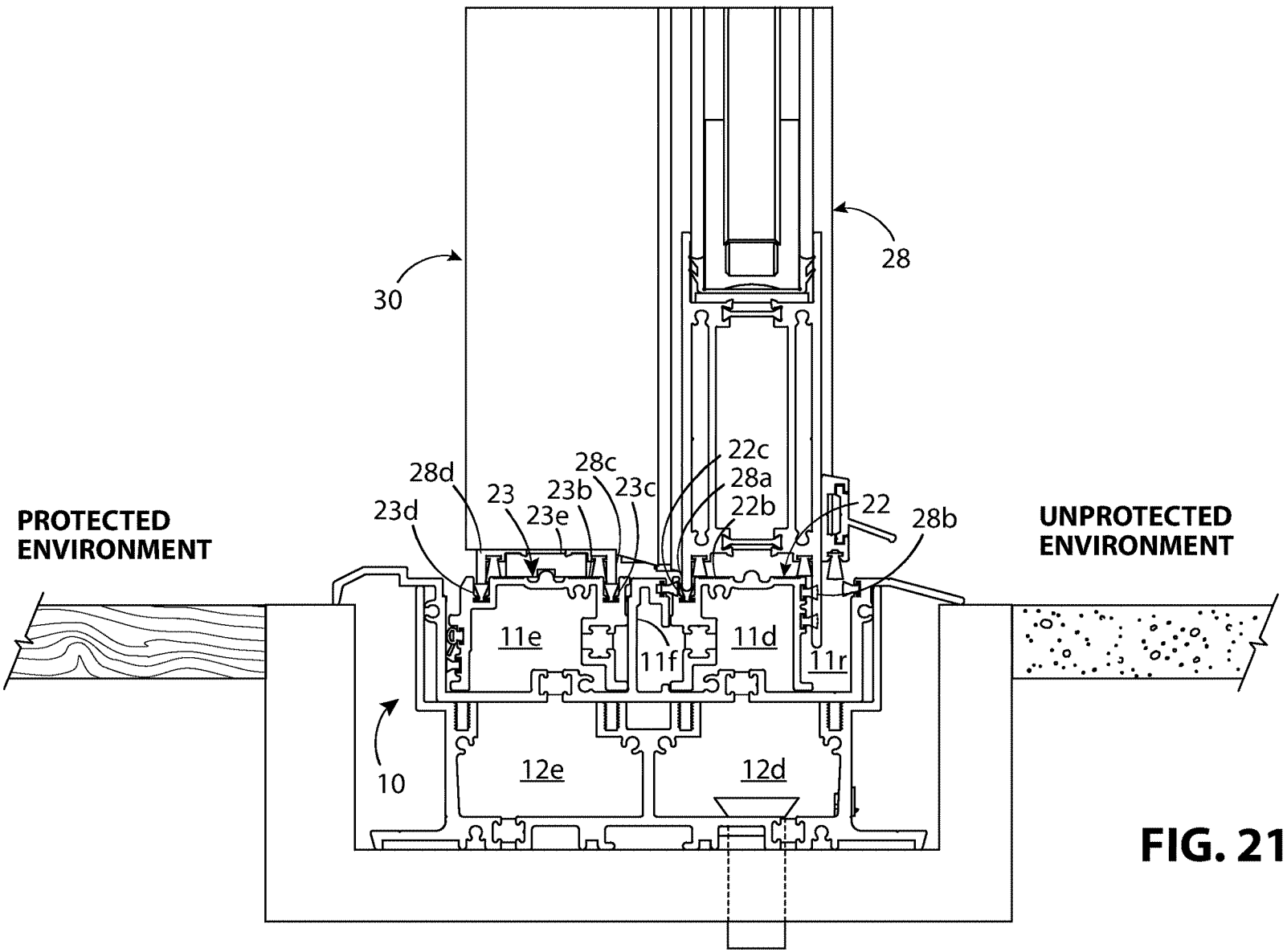
FIG. 21 illustrates a side elevation view of the sill assembly of FIG. 1 installed in a typical installation environment, with the threshold inserts configured to receive a sliding door assembly with a portion of the sliding door assembly shown.
Figure 22:
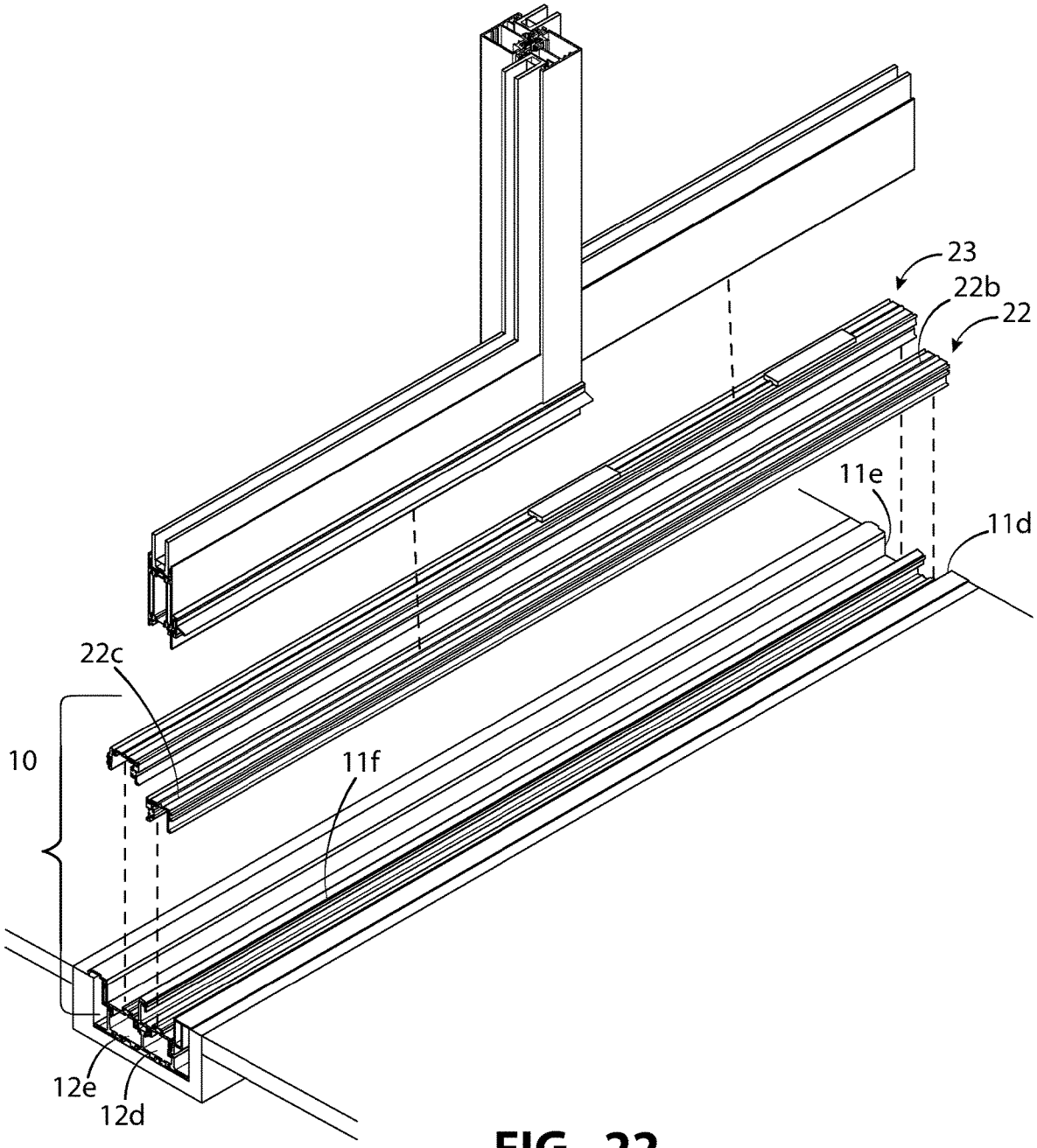
FIG. 22 illustrates an isometric view of FIG. 21 with the threshold inserts and the portion of the sliding door assembly exploded away from the sill assembly and the environment.

FIGS. 21 and 22 illustrate the sill assembly 10 adapted for use with a sliding door by simply replacing other first threshold inserts with the first threshold insert 22 and replacing second threshold inserts with second threshold insert 23. The first threshold insert 22 is aligned over and mounted within the first sill cavity 11*d*. The first threshold insert 22 can form a first top surface of the sill 11 and can form a first top surface of the sill assembly 10. The second threshold insert 23 is aligned over and can be mounted within the second sill cavity 11*e*. The second threshold insert 23 forms a second top surface of the sill 11. Referring to FIGS. 13, 21 and 22, the first threshold insert 22 includes a threshold top wall 22*b* with a groove 22*c* along the length (i.e., longitudinally) of the first threshold insert 22 where the groove 22*c* is adjacent to the sill upleg 11*f*. Referring to FIG. 21, the groove 22*c* is sized and shaped to receive a second downleg 28*a*. Referring to FIG. 21, the first threshold insert 22 is undersized widthwise to create an open cavity 11*r* for receiving a first downleg 28*b*. Referring to FIG. 13, the first downleg 28*b* is received between gaskets 11*o* and gaskets 22*d*, 22*e*. Referring to FIG. 21, a stationary door 30 includes a first downleg 28*c* received by a first groove 23*c* in the top wall 23*b* of the second threshold insert 23. A second downleg 28*d* is received by a second groove 23*d* in the top wall 23*b* of the second threshold insert 23. The door rests on a gasket 23*e*. The first downleg 28*b* and the second downleg 28*d* keep the door from blowing out under high pressure. For example, the high pressure could be from a windstorm or hurricane. The top wall 23*b*, first groove 23*c*, second groove 23*d*, and gasket 23*e* are also illustrated in FIG. 13.

Referring to FIGS. 21 and 22, the sliding door 28 is aligned over the first sill cavity 11*d* and the first subsill cavity 12*d*. The principle of operation of water drainage and air flow can be the same or similar to what was described for FIG. 14. The first sill cavity 11*d* and the first subsill cavity 12*d* can form a first vertically-stacked pressure chamber pair within the unprotected environment. The second sill cavity

11*e* and the second subsill cavity 12*e* can form a second vertically-stacked pressure chamber pair within the protected environment.

Referring to FIGS. 10-12, the threshold insert body 14*a* can optionally be thermally broken by a thermal break 14*c*. Similarly, the first threshold insert 13 of FIG. 10, the first threshold insert 20 of FIG. 11, and the first threshold insert 21 of FIG. 12 can include thermal breaks 13*a*, 20*a*, 21*a*, respectively. Referring to FIG. 13, the first threshold insert 22 can be thermally broken by thermal break 22*a*. The second threshold insert 23 can be thermally broken by thermal breaks 23*a*. Referring to FIGS. 10-13, together with thermal breaks 11*m*, 11*n* in the sill 11 and thermal break 12*t*, 12*u* in the subsill 12, the sill assembly 10 can be thermally broken between protected and unprotected environments. The thermal break can be a thermal strut, structural foam, or other structural thermally isolating materials that can rigidly join the sub-portions of the threshold insert body 14*a* together.

FIGS. 1-22 have shown one example of sill assembly 10 of the present disclosure. FIGS. 23-24 illustrate how the sill and threshold inserts of FIGS. 1-22 can optionally be installed without a subsill. The first threshold insert 13 is aligned over and mounted within the first sill cavity 11*d*. The first threshold insert 13 can form a first top surface of the sill 11 and can form a first top surface of the sill assembly 10. The second threshold insert 14 is aligned over and can be mounted within the second sill cavity 11*e*. The second threshold insert 14 can form a second top surface of the sill 11 and can form a second top surface of the sill assembly 10. FIG. 23 illustrates the sill assembly 10 with drain tube 19 extending through sill bottom wall 11*a* within the first sill cavity 11*d* and drain tube 31 extending through the sill bottom wall 11*a* within the second sill cavity 11*e*. FIG. 24 illustrates the sill assembly 10 installed in a drain trough 15. The first sill cavity 11*d* can drain into the drain trough 15 by weep hole 11*k* that is shown with an optional weep flap to prevent back flow of water from the drain trough 15. Referring to FIG. 25, the sill 11 includes cutouts 11*s*, 11*t* in the first sill cavity 11*d*, cutouts 11*u*, 11*v* in the second sill cavity 11*e*, and apertures 11*w*, 11*x* in the sill upleg 11*f*, for channeling water out of the weep hole 11*k* of FIG. 24. In FIG. 25, to prevent back flow from the first sill cavity 11*d* back into the second sill cavity 11*e*, apertures 11*w*, 11*x* can optionally include one-way valves. Referring to FIG. 24, as in the previous examples, the operable door, which in this case is an inswing door 24, is mounted over the first sill cavity 11*d*. Referring to FIGS. 23 and 24, the operable door divides the unprotected environment from the protected environment with the first sill cavity 11*d* and first threshold insert 13 forming a first pressure chamber positioned within the unprotected environment. The second sill cavity 11*e* and the second threshold insert 14 form a second pressure chamber within the protected environment.

The first sill flange 11*h* can mount the sill assembly 10 to the exterior floor 16 and the second sill flange 11*i* can mount the sill assembly 10 to the interior floor 17. The first sill flange 11*h* and the second sill flange 11*i* extend outward from the sill 11 in opposite directions. The first threshold insert 13 and second threshold insert 14 are attached to the sill 11 typically by silicone or other water tight sealant but may be attached by threaded fasteners, or adhesive. The first threshold insert 13 is structured to accommodate a swing door, such as the inswing door 24 in FIG. 24. Continuing to refer to FIGS. 23 and 24, as discussed and illustrated for FIGS. 1-22, the first threshold insert 13 can be exchanged for the first threshold inserts 20, 21 to accommodate a pivot door and a folding door, respectively. The first threshold insert 13 and second threshold insert 14 can be exchanged for first threshold insert 22 and the second threshold insert 23 to accommodate a sliding door. In these examples, the operable door (for example, the pivot door, the folding door, or the sliding door), is aligned over the first sill cavity 11*d*. With the operable door dividing the protected environment from the unprotected environment, the first sill cavity 11*d* and first threshold insert 13 forming a first pressure chamber positioned within the unprotected environment. The second sill cavity 11*e* and the second threshold insert 14 form a second pressure chamber within the protected environment.

FIGS. 26 and 27 illustrate how the sill assembly 40 can be modified for use with a sliding glass door assembly with three or more door components. Referring to FIG. 26, in this example, there is one operable door, sliding door 44 and two stationary doors, stationary doors 45, 46. Referring to FIGS. 26 and 27, the sill assembly 40 includes a sill 41, a subsill 42, and the first threshold insert 22, second threshold insert 23, and third threshold insert 32. The sill 41 includes a first sill cavity 41*d* (FIG. 26), a second sill cavity 41*e*, and a third sill cavity 41*f*. The first threshold insert 22 is aligned over and mounted within the first sill cavity 41*d*. The first threshold insert 22 can form a first top surface of the sill 41 and can form a first top surface of the sill assembly 40. The second threshold insert 23 is aligned over and can be mounted within the second sill cavity 41*e*. The second threshold insert 23 can form a second top surface of the sill 41 and a second top surface of the sill assembly 40. The third threshold insert 32 is aligned over and can be mounted within the third sill cavity 41*f*. The third threshold insert 32 can form a third top surface of the sill 41 and can form a third top surface of the sill assembly 40. The subsill 42 includes a first subsill cavity 42*d*, a second subsill cavity 42*e*, and a third subsill cavity 42*f*. Referring to FIG. 27, an upper subsill cavity is formed in a region above the uplegs 42*u*, 42*v* and between first subsill sidewall 42*a* and second subsill side wall 42*b*. The sill 41 can be positioned partially within upper subsill cavity.

Referring to FIG. 26, the sliding door 44 is aligned over the first sill cavity 41*d* and the first subsill cavity 42*d*. The sill and subsill are constructed to create vertically-stacked pressure chamber pairs. The first sill cavity 41*d* combined with the interior of the first threshold insert 22 creates a pressure chamber aligned over the pressure chamber created by the sill bottom wall 41*a* and the first subsill cavity 42*d*. The second sill cavity 41*e* combined with the interior of the second threshold insert 23, located midway, creates a pressure chamber aligned over the pressure chamber created by the sill bottom wall 41*a* and the second subsill cavity 42*e*. The third sill cavity 41*f* combined with the third threshold insert 32, far-left located, creates a pressure chamber aligned over the pressure chamber created by the sill bottom wall 41*a* and the third subsill cavity 42*f*. First threshold insert 22, second threshold insert 23, and third threshold insert 32 are also illustrated in FIG. 27.

Referring to FIG. 27, the subsill can be further divided lengthwise by tabs 42*g*, 42*h*, 42*i*, 42*j* to create additional pressure chambers and compartmentalize the subsill. The subsill can include one or more weep holes for example, the weep holes 42*k*, 42*m*, 42*n*. In addition, the subsill can include one or more cutouts and/or one or more apertures in the uplegs, for example apertures 42*o*, 42*p*, 42*q* in upleg 42*u* and apertures in upleg 42*v* that are hidden from view. These apertures combined with the weep holes drain water out of the compartmentalized pressure chambers into the drain trough 15 of FIG. 26. To prevent back flow of water from the first subsill cavity 42*d* into the second subsill cavity 42*e*, apertures 42*o*, 42*p*, 42*q* can optionally include one-way valves. Backflow and pressure can be controlled and fine-tuned by selectively applying one-way valves to the apertures.

Continuing to refer to FIG. 27, the sill 41 can include apertures and cutouts, for example, apertures 41*g*, 41*h* in upleg 41*i*, and cutouts 41*j*, 41*k* to drain water collected in the first sill cavity 41*d* and the second sill cavity 41*e* out the weep holes 42*r*, 42*s*, 42*t*. Weep holes 42*k*, 42*m*, 42*n*, 42*r*, 42*s*, 42*t* can optionally include weep flaps to prevent water from backflowing into the sill 41 or subsill 42. To prevent backflow into the second sill cavity 41*e*, apertures 41*g*, 41*h* can be equipped with one-way valves.

Referring to FIG. 26, a first downleg 44*a* projecting downward from the sliding door 44 slides along an open cavity 41*m* and second downleg 44*b* slides along a groove in the first threshold insert 22. The sliding door 44 can be top or bottom loaded. The stationary doors 45, 46 are attached and mounted to the second threshold inserts 23, and third threshold insert 32, respectively, as described for FIG. 21 for second threshold insert 23. The first downleg 45*c* and the second downleg 45*d* of the stationary door 45 engage the first groove 23*c* and the second groove 23*d*, respectively, of second threshold insert 23. The first downleg 46*c* and the second downleg 46*d* of the stationary door 46 engage the first groove 32*c* and the second groove 32*d*, respectively, of third threshold insert 32.

Figure 28:
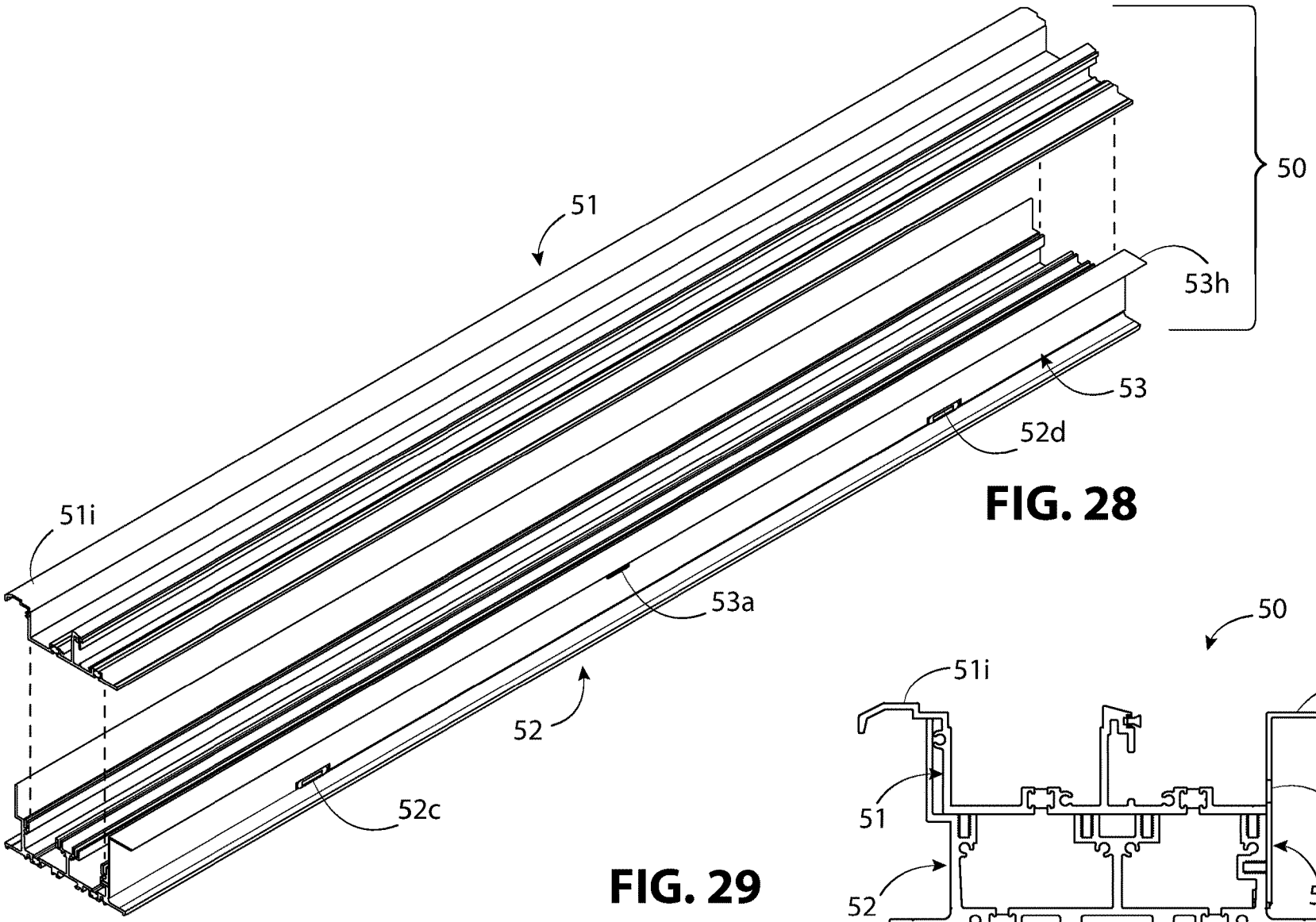
FIG. 28 illustrates an exploded and isometric view of an alternative version of a sill assembly of the present disclosure with the threshold inserts removed for clarity.
Figure 29:
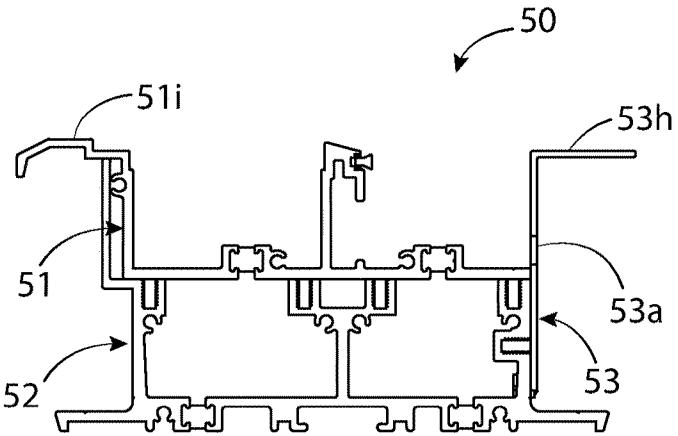
FIG. 29 illustrates a side view of the sill assembly of FIG. 27 with the threshold inserts also removed for clarity.

FIGS. 28-31 show variants of the sill and subsill that can be used with the threshold inserts of FIGS. 1-22. FIGS. 28 and 29 illustrate a sill assembly 50, less the threshold inserts, where the sill 51 is flanged on one side. Rather than the sill flanges extending outward from the sill in opposite directions, the bracket 53 can attach to the subsill 52. Here the first flange 53*h* of the bracket 53 and the second sill flange 51*i* of the sill 51 extend in opposite directions with the first flange 53*h* extending outward from the subsill 52 and the sill 51. While the shape of the bracket 53 is of an L-bracket, it can be stamped, extruded, or otherwise formed into any desirable shape. Referring to FIG. 28, the bracket 53 can include cutouts to accommodate weep holes 52*c*, 52*d* in the subsill 52. The bracket itself can also include a weep hole 53*a* adjacent to the sill 51. Weep hole 53*a* is also shown in FIG. 29. Referring to FIG. 28, the weep holes 52*c*, 52*d*, 53*a* can optionally include weep flaps to prevent water backflow.

Referring to FIG. 29, the sill 51 and subsill 52 can accept the first threshold inserts 13, 20, 21, 22 of FIGS. 10, 11, 12, and 13 respectively, the second threshold insert 14 of FIGS. 10, 11, and 12, and the second threshold insert 23 of FIG. 14 to accommodate different door types including swing doors, pivot doors, folding doors, and/or sliding doors. The principle of operation is the same as described for these figures. The sill 51 and subsill 52 create a first vertically-stacked pressure chamber pair and a second vertically-stacked pressure chamber pair and can drain water out of the system using the same principles as described for FIG. 14.

Figure 30:
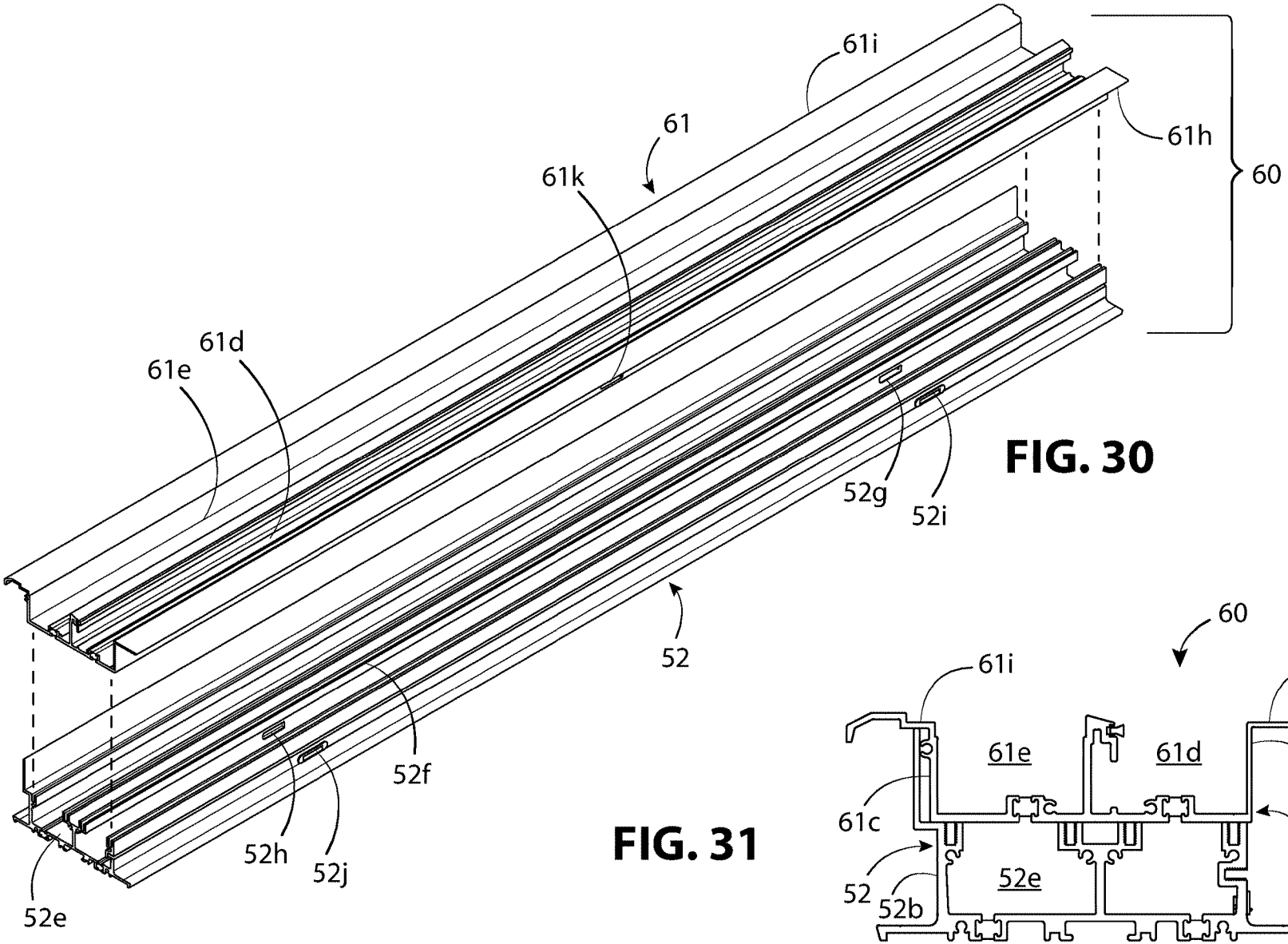
FIG. 30 illustrates an exploded and isometric view of another alternative version of a sill assembly of the present disclosure with the threshold inserts removed for clarity.
Figure 31:
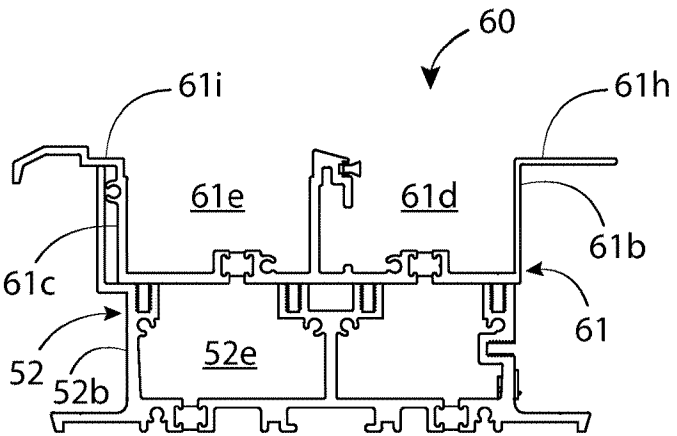
FIG. 31 illustrates a side view of the sill assembly of FIG. 29 with the threshold inserts also removed for clarity.

FIGS. 30 and 31 illustrate a sill assembly 60, less the threshold inserts, that uses subsill 52 discussed for FIGS. 29 and 30, but without bracket 53. Referring to FIGS. 30 and 31, instead, the sill 61 includes first sill flange 61*h* and second sill flange 61*i*. The first sill flange 61*h* and the second sill flange 61*i* extend outward from the sill in opposite directions. The first sill flange 61*h* is shaped to form a right-angle like an inverted L-bracket as with bracket 53. The second sill flange 61*i* can be shaped like the second sill flange 11*i* of FIGS. 8 and 9. The sill 61 can be extruded, cast, or otherwise formed with the first sill flange 61*h* and the second sill flange 61*i* having any desired shape.

Referring to FIG. 31, the sill 61 and subsill 52 can accept the first threshold inserts 13, 20, 21, 22 of FIGS. 10, 11, 12, and 13 respectively, the second threshold insert 14 of FIGS. 10, 11, and 12, and the second threshold insert 23 of FIG. 14 to accommodate swing doors, pivot doors, folding doors, and/or sliding doors. The principle of operation is the same as described for these figures.

The sill 61 and subsill 52 create a first vertically-stacked pressure chamber pair and a second vertically-stacked pressure chamber pair and can drain water out of the system using similar principles as described for FIG. 14. One difference being that subsill 52 does not surround both the first sill sidewall 61*b* and the second sill sidewall 61*c*. Referring to FIG. 31, as it may be desirable to surround both sidewalls, a version of the bracket 53 of FIG. 28 can be added to the subsill 52 where the bracket is shaped like the second subsill sidewall 52*b* to surround both the first sill sidewall 61*b* and the second sill sidewall 61*c*. A flat or planar version of the bracket can be added to accomplish the same purpose.

Referring to FIGS. 30 and 31, the sill 61 can drain out water accumulated in the first sill chamber 61*d* by a weep hole 61*k* (FIG. 30). The weep hole can optionally include a weep flap attached to it to prevent backflow of water into the first sill chamber 61*d*. Any water that finds its way into the second sill chamber 61*e* can drain through an aperture (not shown) in the base of the sill into the second sill chamber 52*e*. Referring to FIG. 30, water accumulated in the second sill chamber 52*e* can drain out the subsill 52 through apertures 52*g*, 52*h* in the subsill upleg 52*f* and then through weep holes 52*i*, 52*j*. The weep holes can optionally include weep flaps attached to them to prevent backflow of water. Apertures 52*g*, 52*h* can optionally include one-way valves to prevent backflow of water.

Figure 32:
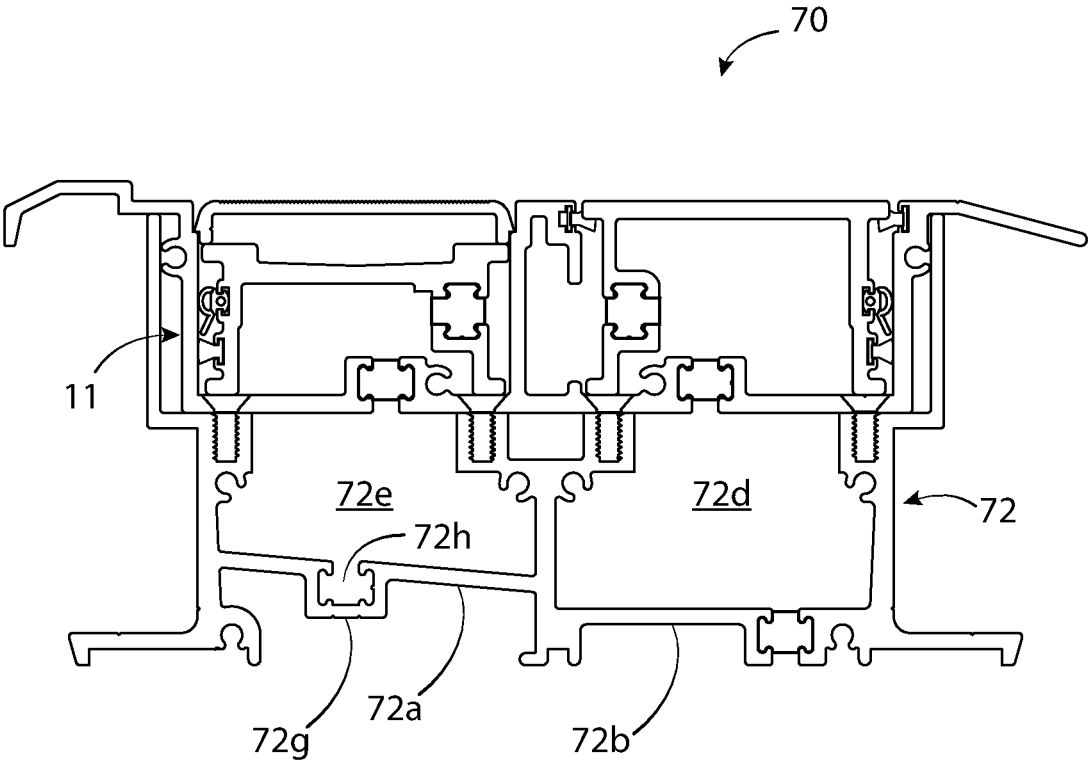
FIG. 32 illustrates a side view of sill assembly similar to the sill assembly of FIG. 1 that includes a subsill with an alternative draining configuration.

FIG. 32 illustrates sill assembly 70, where the subsill bottom wall 72*a* of the subsill 72 under the second subsill cavity 72*e* is angled downward from back to front to facilitate draining using gravity. The subsill bottom wall 72*a* is shown continuous (i.e., not thermally broken). The sill assembly 70 is otherwise identical with the sill assembly 10 of FIG. 1. For instance, in FIG. 32, sill assembly 70 utilizes sill 11, and operates by the same principles. Because the subsill bottom wall 72*a* under the second subsill cavity is angled to take advantage of gravity, while the subsill bottom wall 72*b* under the first subsill cavity 72*d* is horizontal, this creates greater pressure with the pressure chamber of the second subsill cavity 72*e* as compared with the pressure chamber of the first subsill cavity 72*d*. It is also possible to angle the subsill bottom wall 72*b* from back to front as well to facilitate more aggressive draining.

While the subsill bottom wall 72*a* is illustrated as not thermally broken, it can easily be thermally broken by breaking the tab 72*g* and filing the cavity 72*h* with a thermal material with enough strength to retain the strength and rigidity of the subsill under normal operation. For example, the thermal material can be a thermal strut made of polyamide or the thermal material can be poured polyurethane.

Sill assemblies have been described. This disclosure does not intend to limit the claimed subject matter to the examples and variations described in the specification. Those skilled in the art will recognize that variations will occur when embodying the claimed subject matter in specific implementations and environments. While the sill assembly is illustrated positioned between a protected and unprotected environment, it is possible to use the sill assembly where this distinction does not exist. For example, the sill assembly can be installed in a store entrance within an indoor shopping mall.

The figures illustrate possible approaches to installing the sill assembly. For example, FIG. 1 illustrates a portion of the sill assembly 10 recessed in a drain trough 15 below exterior floor 16 and interior floor 17. The sill assembly 10 can be similarly recessed without the drain trough. For example, it can reside in drain rock above a French drain. In addition, a second subsill could reside below the subsill 12, where a portion of the sill 11 and subsill 12 reside within the second subsill.

FIGS. 1, 8, 9, 14, 15, 17, 18, 21, 23, 24, and 26 illustrate shaded cross sections of the floor. The shaded cross section within the protected environment is illustrated as wood. The shaded cross section within the unprotected environment is illustrated as concrete. This illustrates a typical installation environment. The sill assemblies throughout this disclosure can be installed with a variety of materials. For example, wood, concrete, cement board, composite, engineered wood, oriented strand board (OSB), natural or synthetic stone, and other flooring materials typically used in building construction.

The sill assembly 10, 40, 50, 60, 70 of FIG. 1, 26, 29, 31, 32, respectively show flanges extending in opposite directions lengthwise along the sills. The flanges can be used to transition from the floor to the top of the sill. These sill flanges were illustrated in several shapes. These were examples of flange shapes and heights that could meet ADA regulations while creating a small backstop to help improve water performance. The flanges can be modified to other shapes. For example, one or both flanges could be linearly ramped like the first sill flange 11*h* of FIG. 1. One or both flanges can be parallel to the floor surface like the first flange 53*h* belonging to the bracket 53 of FIG. 29.

The sill assembly 10 was illustrated with an inswing door 24 in FIG. 14, an outswing door 25 in FIG. 15, a pivot door 26 in FIG. 17, a folding door 27 in FIG. 18, and a sliding door 28 in FIG. 21 simply by changing one or both threshold inserts. Inswing doors and outswing doors, can be single, multiple, or French doors. Folding doors and sliding doors can be top loaded or bottom loaded.

Throughout the figures, the sill 11 and subsill 12 are illustrated as separate parts. However, the sill 11 and subsill 12 could be extruded or formed together as one part. This can be applied to the sill assembly 10 of FIG. 1, the sill assembly 40 of FIG. 26, the sill assembly 50 of FIG. 29, the sill assembly 60 of FIG. 31, and the sill assembly 70 of FIG. 32. The resulting sill would have fewer parts. However, because of manufacturing constraints, the sill with combined features could have reduced performance as compared to a separate sill and subsill design. Therefore, there is likely to be a trade-off between cost and logistical savings of a sill that combines sill 11 and subsill 12 into one extrusion or formed part vs. the sill 11 and the subsill 12 that are separately extruded or otherwise formed.

As illustrated in FIGS. 14, 15, 17, and 18, one second threshold insert can be used in combination with different first threshold inserts to mount swing doors, folding doors, and pivot doors. For example, first threshold insert 13 in combination with second threshold insert 14 in FIGS. 14 and 15 can accommodate swings doors, first threshold insert 20 with second threshold insert 14 in FIG. 17 can accommodate pivot doors, and first threshold insert 21 in combination with second threshold insert 14 in FIG. 18 can accommodate folding doors. In these examples, to simplify the sill assembly, the second threshold insert 14 with the sill 11 can be extruded or formed together as one assembly and still accommodate the above-mentioned door types. However, some other door types may require the first threshold insert and the second threshold insert both be changed. In this case, a sill assembly with a second threshold insert formed as part of the sill may accommodate fewer door types than a sill assembly where the second threshold insert and the sill are separate parts.

FIGS. 14, 15, 17, 18, 21, 24, and 26 illustrate sill assemblies used to accommodate various door types. The sill assembly 10 of FIGS. 14, 15, 17, 18, 21, and 24, sill assembly 40 of FIG. 26, as well as sill assembly 50 of FIG. 29, sill assembly 60 of FIG. 31, and sill assembly 70 of FIG. 32 can be also used with windows as well as doors. These sill assemblies can be used for ingress and egress windows that meet ADA. Alternatively, they can also be used for low-profile ingress and egress windows, as well as in standard window openings. For example, the sill assembly 10 can be used as illustrated in FIGS. 14 and 15 for casement windows and swing windows, as illustrated in FIG. 17 for vertical pivot windows, as illustrated in FIG. 18 for folding windows, and/or as illustrated in FIG. 21 for sliding windows. The sill assembly 10 of FIGS. 24 and 25 can be used for the above-mentioned window types by changing out first threshold insert 13 and/or second threshold insert 14 to accommodate the various windows types as described for accommodating the various door types. The sill assembly 40 of FIG. 26 can be used for sliding windows with three or more sashes. As illustrated, it can be used for a sliding window with one operable sash and two fixed sashes (XOO). The window can have two operable sashes and one fixed sash (XOX) by swapping out the second threshold insert 23 for another of the first threshold inserts 22. The sill assembly 40 can be positioned so the operable sashes are positioned within the unprotected environment and the fixed sash is within the protected environment.

This disclosure has discussed many types of doors and windows that can be mounted and/or otherwise accommodated by the various sill assemblies by simply changing one or more of the threshold inserts. This list is not meant to be exhaustive. Other door and window types can be accommodated in a similar way by changing the shape and/or size of the threshold insert body and/or threshold insert top surface.

It is possible to implement features described in separate examples in combination within a single example. Similarly, it is possible to implement features described in one example either separately or in combination in multiple examples. For example, the subsill 72 of FIG. 32 can be modified for use with the other disclosed sill assemblies, for example, sill assembly 60 of FIG. 31, sill assembly 50 of FIG. 29, or sill assembly 40 of FIG. 26. The inventor envisions that these variations fall within the scope of the claimed subject matter.

End dams can be used on the sill assemblies, for example, sill assembly 10, 40, 50, 60, 70, to make the sills watertight on the ends. The end dams can be attached to the open ends of the sill by threaded fasteners. These can, for example, threadedly engage lengthwise bosses in the sill and subsill. The end dams can alternatively be attached by silicone or adhesive or by a combination of threaded fasteners and silicone. The end dams can be installed before the sill assembly is placed between the door jambs. Optionally, portions of the end dams, extending above the sill can be in combination with threaded fasteners, to attach the end dam to the door jamb.

The sill assemblies can use first threshold inserts of one type side-by-side with a first threshold insert of another type to accommodate different door or window types side-by-side over a common sill assembly. For example, referring to FIG. 2, the first threshold insert 20 of FIG. 19 can be placed lengthwise along the first sill cavity 11*d* side-by-side with the first threshold insert 13 to allows a pivot door to be placed next to a swing door. The first threshold insert 21 of FIG. 20 can be placed lengthwise along the first sill cavity 11*d* side-by-side with the first threshold insert 13 to allow a folding door to be placed next to a swing door. Second threshold insert 23 of FIG. 21 can be placed lengthwise along the first sill cavity 11*d* and side-by-side with the first threshold insert 13 to place a non-operable window (i.e., fixed lites) next to a swing door. Using the same principles, various combinations doors or windows that can be accommodated by the sill assemblies of this disclosure can be placed side-by-side by placing corresponding threshold inserts side-by-side within the sill cavities. For example, a pivot door can be placed side-by-side with fixed lites. A folding door can be placed side-by-side with a pivot door. A folding door can be placed side-by-side with a fixed lite.

The figures illustrate the sill assemblies with thermal breaks. The sill assemblies 10, 40, 50, 60, 70 can be used without thermal breaks. The sill assemblies can be constructed without thermal breaks. Alternatively, the can be constructed with breakaway tabs, such as tab 72*g* of FIG. 32 so that thermal breaks can optionally be added.

"Optional" or "optionally" is used throughout this disclosure to describe features or structures that are optional. Not using optional or optionally to describe a feature or structure does not imply that the feature or structure is required, essential, or not optional. As used throughout this disclosure the word "or" has the same meaning as and/or, i.e., an "inclusive or", unless modified by a qualifier that limits the meaning of "or" to an "exclusive or." An example of a qualifier that limits the meaning of "or" is the word "either."

While the examples and variations are helpful to those skilled in the art in understanding the claimed subject matter, the scope of the claimed subject matter is defined solely by the following claims and their equivalents.

What is claimed is:

1. A sill assembly, comprising:

a sill including a sill bottom wall, a sill upleg projecting directly from the sill bottom wall lengthwise along the sill, a first sill cavity and a second sill cavity separated by the sill upleg;

a first threshold insert mounted within the first sill cavity and forming a first top surface of the sill, and a second threshold insert aligned over the second sill cavity and forming a second top surface of the sill; and the first threshold insert can be changed to accommodate different door types without modification to the sill.

2. The sill assembly of claim 1 wherein:

the second threshold insert mounted within the second sill cavity; and one or both of the first threshold insert and the second threshold insert can be changed to accommodate different door types without modification to the sill.

3. The sill assembly of claim 2, wherein:

the first threshold insert and the first sill cavity form a first pressure chamber; and the second threshold insert and the second sill cavity form a second pressure chamber.

4. The sill assembly of claim 2, wherein:

the first threshold insert is constructed to receive an operable door and to reside within an unprotected environment; and with the operable door positioned over the first threshold insert and the operable door separating the unprotected environment from a protected environment, the first threshold insert and the first sill cavity form a first pressure chamber within the unprotected environment and the second threshold insert and the second sill cavity form a second pressure chamber within the protected environment.

5. The sill assembly of claim 1, wherein:

the different door types comprise a swing door and a sliding door.

6. The sill assembly of claim 1, further comprising:

a one-way valve positioned within the sill upleg allowing water to flow from the second sill cavity to the first sill cavity but preventing backflow through the one-way valve.

7. The sill assembly of claim 1, further comprising:

a subsill positioned under the sill; and one or both of the first threshold insert and the second threshold insert can be changed to accommodate the different door types without modifying the subsill.

8. The sill assembly of claim 1, further comprising:

a subsill including a subsill bottom wall, a subsill upleg projecting directly from the sill bottom wall, a first subsill cavity and a second subsill cavity separated by the subsill upleg; and a one-way valve positioned within the subsill upleg allowing water to flow from the second subsill cavity to the first subsill cavity but preventing backflow through the one-way valve.

9. The sill assembly of claim 1, further comprising:

a subsill including a subsill bottom wall, a subsill upleg projecting directly from the sill bottom wall, a first subsill cavity and a second subsill cavity separated by the subsill upleg; and the first sill cavity is aligned over the first subsill cavity and the second sill cavity is aligned over the second subsill cavity, wherein one or both of the first threshold insert and the second threshold insert can be changed to accommodate the different door types without modifying the subsill.

10. The sill assembly of claim 1, wherein:

the first threshold insert and the first sill cavity form a first pressure chamber; and the second threshold insert and the second sill cavity form a second pressure chamber.

11. The sill assembly of claim 1, wherein:

the first threshold insert is constructed to receive an operable door and to reside within an unprotected environment; and with the operable door positioned over the first threshold insert and the operable door separating the unprotected environment from a protected environment, the first threshold insert and the first sill cavity form a first pressure chamber within the unprotected environment and the second threshold insert and the second sill cavity form a second pressure chamber within the protected environment.

12. A sill assembly, comprising:

a sill including a sill bottom wall, a sill upleg projecting directly from the sill bottom wall and extending lengthwise along the sill, a first sill cavity and a second sill cavity separated by the sill upleg;

a first threshold insert mounted within the first sill cavity and forming a first top surface of the sill, and a second threshold insert aligned over the second sill cavity and forming a second top surface of the sill;

a subsill including a subsill bottom wall, a subsill upleg projecting directly from the sill bottom wall, a first subsill cavity and a second subsill cavity separated by the subsill upleg; and the first sill cavity is aligned over the first subsill cavity and the second sill cavity is aligned over the second subsill cavity.

13. The sill assembly of claim 12, further comprising:

a one-way valve positioned within the subsill upleg allowing water to flow from the second subsill cavity to the first subsill cavity but preventing backflow through the one-way valve.

14. The sill assembly of claim 12, wherein:

the sill includes a first sill flange and a second sill flange extending outward from the sill in opposite directions; and the sill positioned partially within the subsill with the first sill flange and the second sill flange extending over the subsill.

15. The sill assembly of claim 12, wherein:

the subsill includes a first subsill sidewall and a second subsill sidewall extending upward from the subsill bottom wall, an upper subsill cavity formed in a region above the subsill upleg and between the first subsill sidewall and the second subsill sidewall; and the sill positioned partially within the upper subsill cavity.

16. The sill assembly of claim 15, wherein:

the sill includes a first sill flange and a second sill flange extending outward from the sill in opposite directions; and the first sill flange and the second sill flange extending over the subsill.

17. The sill assembly of claim 16, wherein:

a pressure chamber formed between the first sill flange, the sill, and the first subsill sidewall.

18. The sill assembly of claim 12, wherein:

one or both of the first threshold insert and the second threshold insert can be changed to accommodate different door types without changing the sill and the subsill.

19. The sill assembly of claim 12, wherein:

the first threshold insert and the first sill cavity with the sill bottom wall and the first subsill cavity form a first vertically-stacked pressure chamber pair; and the second threshold insert and the second sill cavity with the sill bottom wall and the second subsill cavity form a second vertically-stacked pressure chamber pair.

20. The sill assembly of claim 12, wherein:

the first threshold insert is shaped, structured, and positioned to receive an operable door and to reside within an unprotected environment; and with the operable door positioned over the first threshold insert and the operable door separating the unprotected environment from a protected environment, the first threshold insert and the first sill cavity with the sill bottom wall and the first subsill cavity form a first vertically-stacked pressure chamber pair within the unprotected environment and the second threshold insert and the second sill cavity with the sill bottom wall and the second subsill cavity form a second vertically-stacked pressure chamber pair within the protected environment.

* * * * *